US007761929B1

(12) United States Patent
Mascia

(10) Patent No.: US 7,761,929 B1
(45) Date of Patent: Jul. 27, 2010

(54) PROTECTIVE PAD ASSEMBLY

(76) Inventor: Michael Mascia, 1417 Moss St., New Orleans, LA (US) 70119

( * ) Notice: Subject to any disclaimer, the term of this patent is extended or adjusted under 35 U.S.C. 154(b) by 961 days.

(21) Appl. No.: 10/776,412

(22) Filed: Feb. 11, 2004

Related U.S. Application Data

(60) Provisional application No. 60/446,445, filed on Feb. 11, 2003.

(51) Int. Cl.
*A41D 13/00* (2006.01)

(52) U.S. Cl. ..... 2/16

(58) Field of Classification Search ..... 2/16, 2/19, 20, 159, 160, 161.1, 170
See application file for complete search history.

(56) References Cited

U.S. PATENT DOCUMENTS

| | | | | |
|---|---|---|---|---|
| 1,797,116 | A | 3/1931 | Barden | |
| 3,583,704 | A | 6/1971 | Callanan | |
| 3,598,408 | A | 8/1971 | Klose | |
| 3,885,249 | A | 5/1975 | De Brabander | |
| 3,994,025 | A | 11/1976 | Petroski | |
| 4,042,975 | A | 8/1977 | Elliott, Jr. et al. | |
| 4,183,100 | A | 1/1980 | De Marco | |
| 4,190,906 | A | 3/1980 | Patton, Jr. | |
| 4,270,228 | A | 6/1981 | Gaiser | |
| 4,556,215 | A | 12/1985 | Tarbox et al. | |
| 4,590,625 | A | 5/1986 | Keim | |
| 4,617,684 | A | 10/1986 | Green et al. | |
| 4,691,387 | A | 9/1987 | Lopez | |
| 4,754,499 | A | 7/1988 | Pirie | |
| 4,774,724 | A * | 10/1988 | Sacks | 2/2.5 |
| 5,081,715 | A * | 1/1992 | Mascia | 2/20 |
| 5,257,418 | A * | 11/1993 | Jaskiewicz | 2/20 |
| 5,465,425 | A * | 11/1995 | Crispin | 2/102 |
| 6,493,879 | B1 * | 12/2002 | Hibler | 2/49.1 |
| 6,817,032 | B2 * | 11/2004 | Hollander | 2/69 |
| 6,868,553 | B2 * | 3/2005 | Kleinert | 2/19 |

FOREIGN PATENT DOCUMENTS

| | | |
|---|---|---|
| DE | 0148604 | 6/1981 |

OTHER PUBLICATIONS

Velcro Product News, PN. No. 46, Jun. 1978.

* cited by examiner

*Primary Examiner*—Tejash Patel
(74) *Attorney, Agent, or Firm*—Cesari and McKenna, LLP; Patricia A. Sheehan

(57) ABSTRACT

A configurable protective pad assembly includes a first, or base, layer that provides as an inner and/or outer surface one part of a two-part fastener system, such as, for example, the hooks or loops of a hook and loop fastener system. A protective layer, which consists of padding that incorporates fasteners on its surfaces, is sized and arranged relative to the base layer to provide customized protection to one or more desired locations. The protective layer attaches to the base layer as one or more sections that are sized and arranged in positions that correspond to the respective locations in which protection is desired. As desired, additional protective layers may be applied in the same manner, to provide more padding to all or various of the locations. A cover layer having a smooth outer surface may be applied over the protective layers to complete the assembly.

21 Claims, 20 Drawing Sheets

PROTECTIVE PAD ASSEMBLY

CROSS-REFERENCE TO RELATED APPLICATIONS

The present application claims the benefit of U.S. Provisional Patent Application Ser. No. 60/446,445, which was filed on Feb. 11, 2003, by Michael Mascia for a Protective Pad Assembly and is hereby incorporated by reference.

BACKGROUND OF THE INVENTION

1. Field of the Invention

This invention relates generally to shock absorbing devices for protecting body parts from abrasion, and impacts or other forces capable of producing injury and, in particular, to configurable pad assemblies for both therapeutic and prophylactic uses.

2. Background Information

Various body parts, for example, the palm of one's hand, can be subjected to significant trauma when one engages in certain physical activity such as bicycle riding, weight lifting, shoveling, pistol shooting, etc. involving gripping by the hand. Shock forces are transmitted through the article being held, to the hand, especially the palm of the hand. Within the proximal palm is the median nerve. This nerve is particularly vulnerable to trauma within the flexor retinaculum of the palm.

Various types of gloves and pad devices do exist for covering the hand during such activities. For example, U.S. Pat. No. 3,896,498 discloses a palm guard for covering only part of the palm of the user. Some prior gloves and hand guards are provided with shock absorbing materials such as foam rubber, quilting or nap over part or all of their surface areas to provide extra insulation and buffering. See, for example, U.S. Pat. Nos. 3,173,150; 3,598,408; 3,353,265; 4,176,407; 4,183,100; 4,691,387 and 4,590,625. In some cases, the extra padding is releasable from the basic glove structure so that the characteristics of the gloves can be varied to suit the user's particular activity. Examples of protective gloves of this type are disclosed in U.S. Pat. Nos. 3,885,249; 3,994,025 and 4,042,975. While these prior conventional gloves and pads do provide some protection to the hand, they do not offer sufficient protection to the median nerve. As a result, the user may suffer numbness of the thumb, index and third fingers (known as carpal tunnel syndrome) and/or other soft tissue injuries at the base of the thumb following biking, shoveling, use of hand tools, handguns, or other such activity involving strenuous use of the hand.

U.S. Pat. No. 5,081,715, the subject matter of which is incorporated herein by reference, describes a palm protector that includes a plurality of releasably attached layers that are sized to the palm of the hand. While the patented palm protector works well, there are certain injuries or conditions that require more or less protection in is strategic areas of the palm and/or other body areas. Accordingly, I have improved on my earlier invention to provide a protective pad assembly that provides such customized protection.

SUMMARY OF THE INVENTION

The invention is a configurable protective pad assembly which includes a first, or base, layer that provides as an outer and/or inner surface one part of a two-part fastener system, such as, for example, the hooks or loops of a hook and loop fastener system. A protective layer, which consists of padding that incorporates fasteners on its surfaces, is sized and arranged relative to the base layer to provide customized protection to one or more desired locations. The protective layer or layers attach to the base layer as one or more sections that are sized and arranged in positions and configurations that correspond to the respective locations in which protection is desired.

The fasteners of the base layer and the fasteners on at least one surface of the protective layer may mate, to secure the layers directly to one another. Alternatively, the fasteners on the two layers may both be, for example, loops, and one or more double-sided correspondingly sized hook fastener strips are then inserted between the protective layer and the base layer, to secure the protective layer or the sections thereof in place relative to the first layer. As desired, additional protective layers may be applied in the same manner, to provide more padding to all or various of the locations.

The base layer is sized to fit on or over the body part requiring protection, or on an object that comes in contact with the body part. For example, the protective pad assembly may be worn on the user's hand with the base layer covering the palm and portions of the thumb, and the protective layer or layers strategically positioned relative to the base layer to provide extra protection to, for example, a previously injured median nerve. The protective pad assembly may instead be positioned on, for example, a bicycle seat, with the protective layer or layers arranged to provide extra protection on one or more locations of the seat that contact injured or particularly sensitive areas of a given rider's body.

The protective pad assembly may thus be used to provide strategically located is padding, either in place of or in addition to the conventionally-arranged padding provided by bicycle gloves, gel bicycle seats and so forth. The protective pad assembly may further include protective layers that strategically position splints, hot or cold packs, gel pads, thermally resistant material and so forth, to provide added protection or treatment to a given body part. The protective pad assembly may, for example, position a shaped splint proximate to a user's thumb and at the same time provide padding to the median nerve. Once the associated injury has healed, the splint layer may be removed and/or replaced with a less rigid, padded layer.

The configurable protective pad assembly may also be used to provide customized padding and/or protective support to a user's chest, knees and/or other body parts. The assembly may be worn directly by the user or the assembly may be incorporated into sports clothing or equipment. The assembly may further be used with other items, such as mouse pads, keyboards and so forth to provide customized protection and support to, for example, a user's wrists.

BRIEF DESCRIPTION OF THE DRAWINGS

The invention description below refers to the accompanying drawings, of which.

DETAILED DESCRIPTION OF ILLUSTRATIVE EMBODIMENTS

Figure 1:
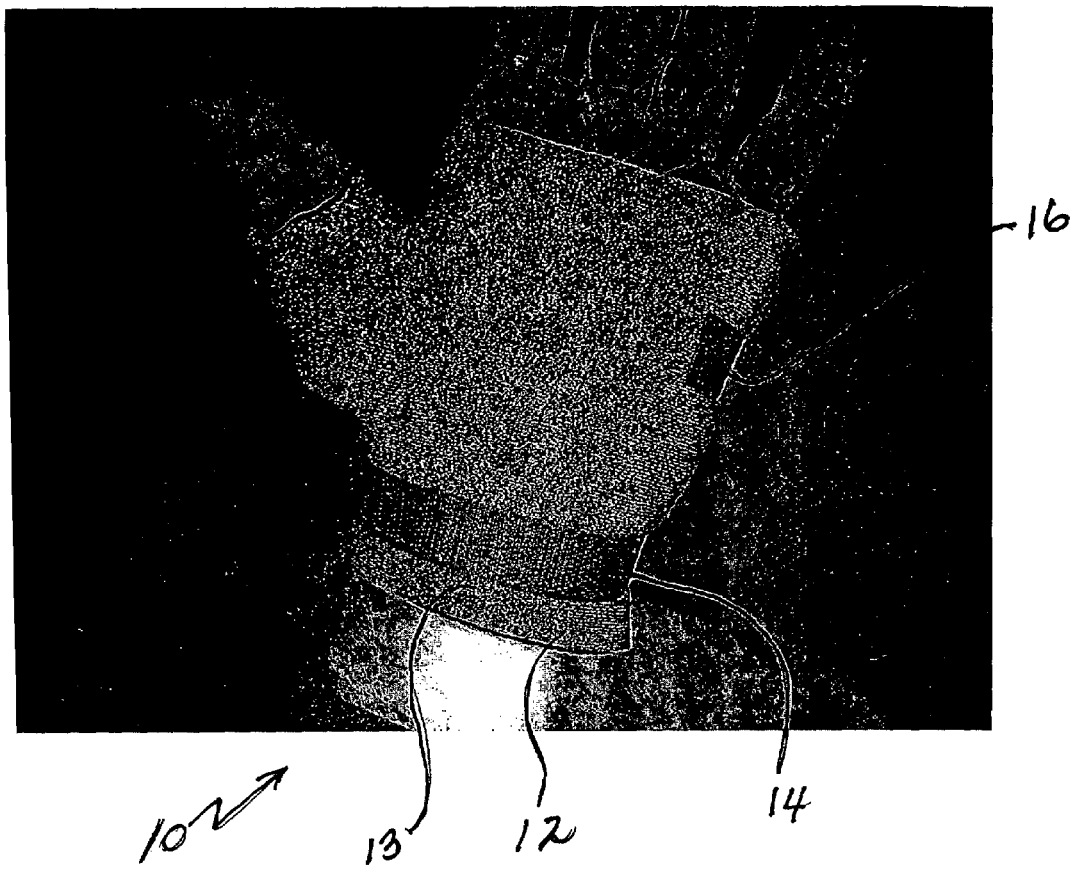
FIGS. 1–7 depict a protective pad assembly constructed in accordance with the invention in use on the hand, with FIGS. 4A–C representing cross-section views of a protective layer included in the assembly.
Figure 2:
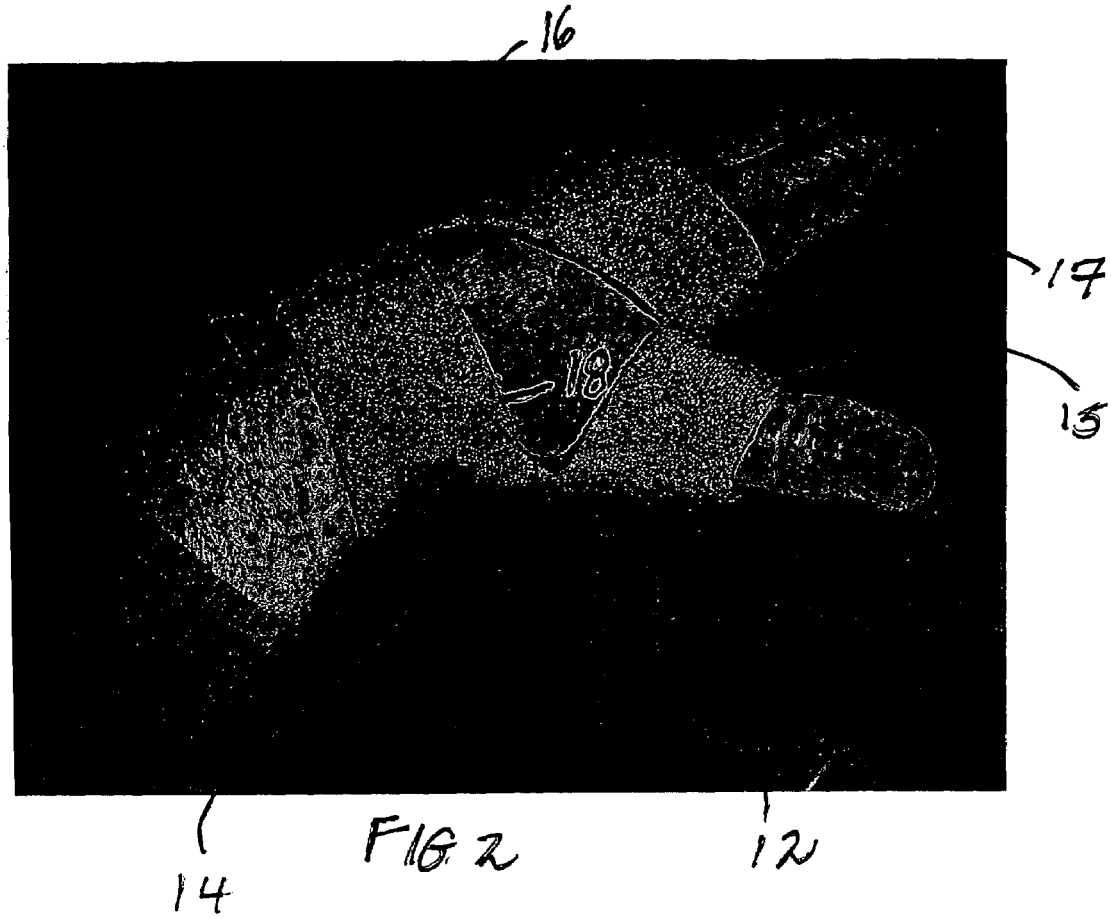

FIGS. 1 and 2 illustrate a first, or base, layer 12 of a protective pad assembly 10 that is designed to protect a user's hand. An outer surface 13 of the base layer 12 incorporates one-half of a two-part fastener system. As illustrated, the outer surface 13 provides the loops of a hook and loop fastener system. The base layer 12 extends continuously over the surface of the user's palm from the palmar crease over the portion of the deep palmar arch from the thenar eminence to the hypothenar muscle group, to the base of the palm. The layer 12 extends, width-wise over the entire width of the hand and encircles a portion of the thumb. Integral straps 14 and 16 contain, on an inner surface thereof (not shown), fastener hooks that mate with the loops on the surface 13. The base layer may, but need not, be a padding layer where additional padding may be applied to the base layer's outer or inner surface. The assembly may be worn over a traditional bicycle glove (not shown) to, as discussed below, provide extra padding to the median nerve, the thumb, and so forth.

Figure 3:
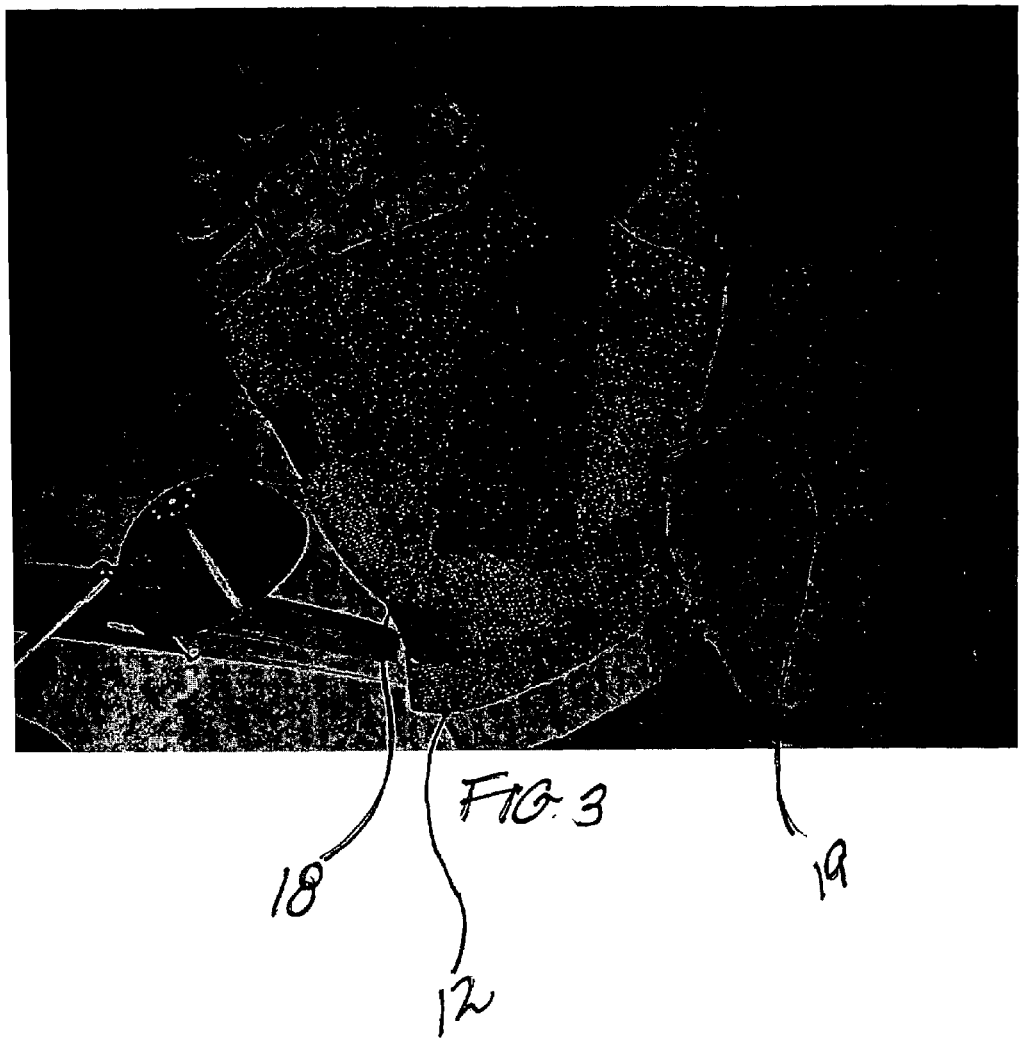

Referring now to FIG. 3, a protective layer 18 is strategically positioned over the base layer to provide padding over the area proximate to the user's median nerve. The protective layer 18 incorporates, in at least one side of its surface 19, fasteners that mate with the fasteners on the surface 13 of the base layer 12. In the example, the protective layer 18 incorporates hooks that mate with the loops of the surface 13. Additional protective layers may be added to the assembly by securing each layer to the previously applied layer or to the inside the base layer. Further, the first protective layer or other layers may be readily repositioned anywhere on the base layer. For example, a protective layer may be applied to the thumb. As discussed in more detail below with reference to FIG. 12, a cover layer with an inner fastener surface and a smooth outer surface may be applied over the protective layers, to complete the assembly.

Figure 4A:
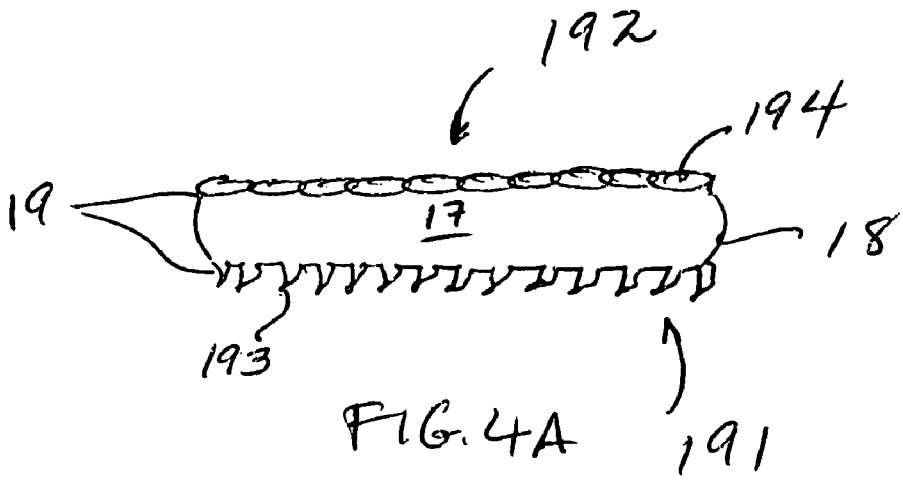
Figure 4B:
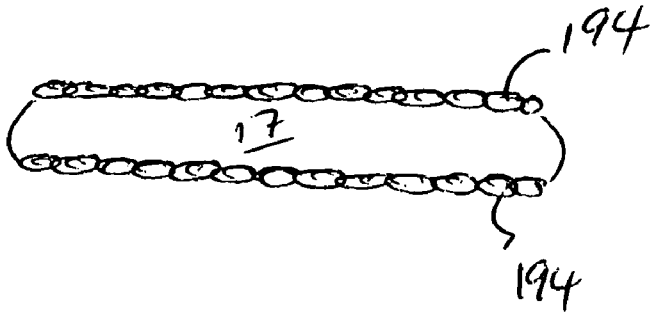
Figure 4C:
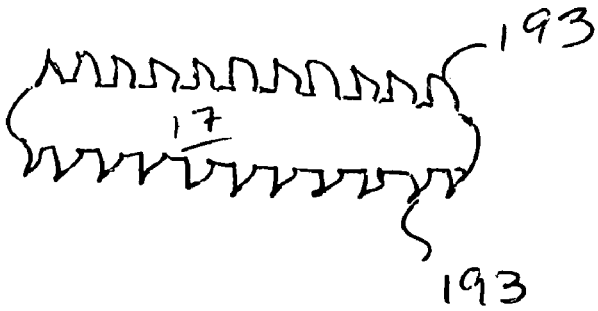

FIGS. 4A–C illustrate in cross-section various configurations of the protective layer 18. The layer consists of padding 17, such as closed cell foam, with integral fasteners incorporated into the outer surface 19. In the example, and as depicted in FIG. 4A, the layer 18 on a first side 191 incorporates into the outer surface hooks 193 that mate with the loops on the surface 13 of the base layer. An opposite side 192 of the layer 18 incorporates into the surface 19 loops 194 that are available for the attaching of a next layer.

The various layers may instead incorporate either all loops or all hooks as depicted in FIGS. 4B and 4C. If layers with all loops and the layers with all hooks are available, the user applies the layers in the appropriate order to secure a next layer directly to a previously applied layer.

Figure 5:
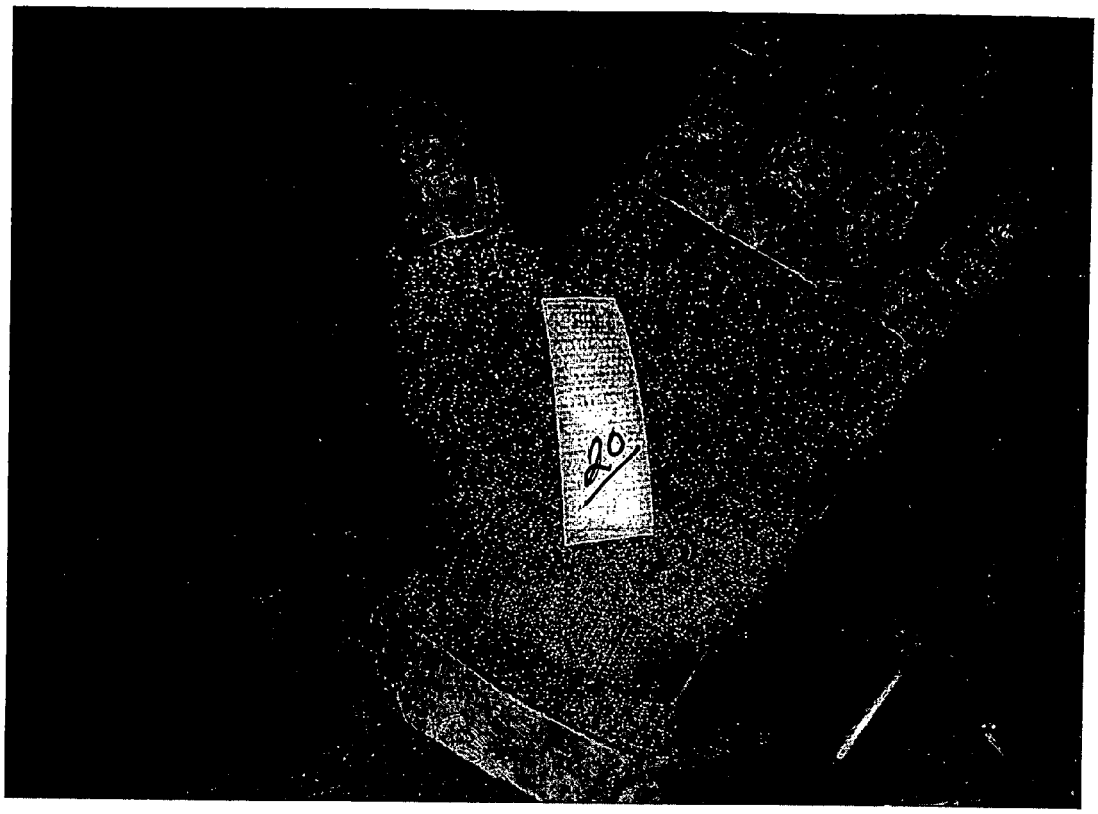

Alternatively, each protective layer 18 may incorporate the same set of fasteners, such that each layer is constructed out of essentially the same material. The layers then attach to one another with double-sided fastener strips 20, as depicted in FIG. 5. The double-sided fastener strips 20 are placed in the locations in which a protective layer or sections thereof are desired.

Figure 6:
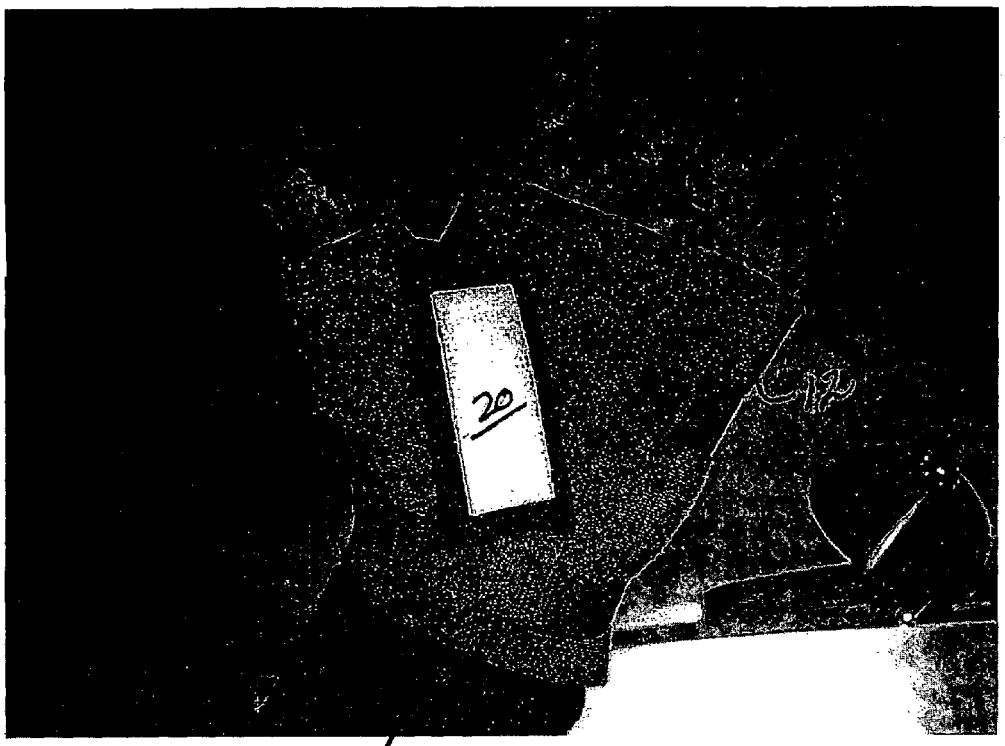
Figure 7:
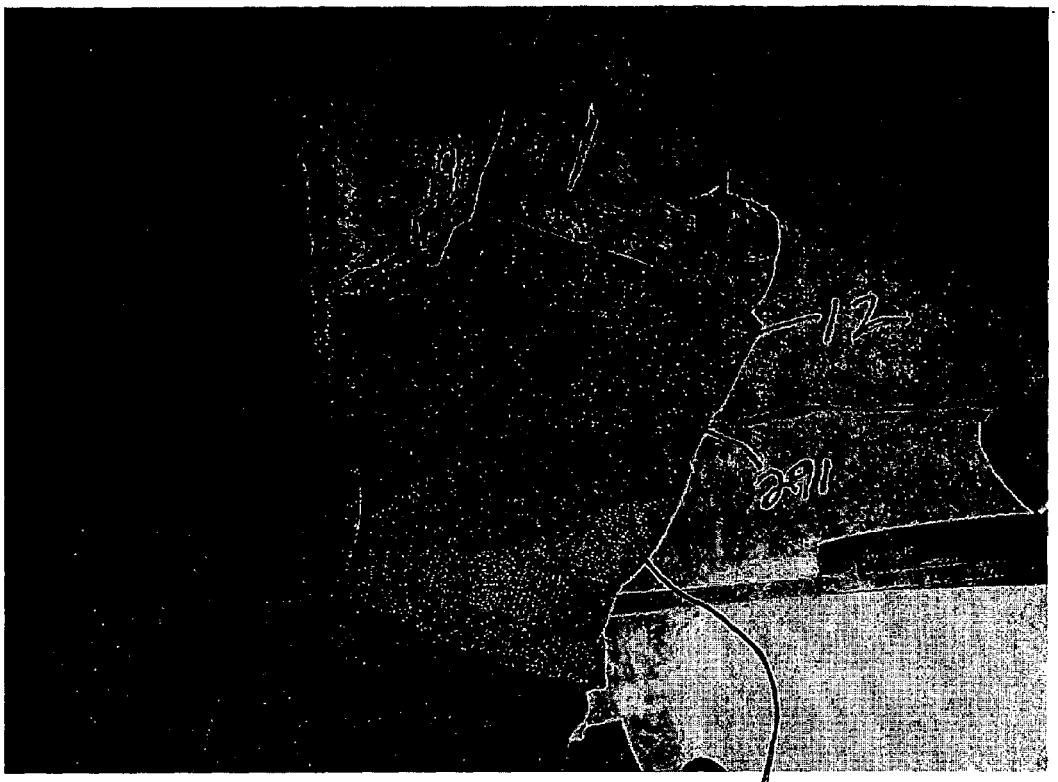

In the example, the double fastener strip 20 includes, on each surface, hooks that mate respectively with the loops of the surface 13 of the base layer and the loops of the surface 19 of the protective layer 18. As shown in FIGS. 6 and 7, additional protective layers 18 may be added by using one or more fastener strips 20 between the layers.

As shown in FIG. 7, a portion 30 of the second protective layer extends beyond the first protective layer 18, such that one layer of padding is provided to the center of the palm and two layers of padding are provided to the area proximate to the median nerve. In the same manner, additional protective layers may be sized, positioned and configured in such a way as to provide an appropriate amount of padding to strategic locations of the particular user's hand.

Each protective layer 18 consists of protective material, such as padding, with fasteners incorporated on the inner and/or outer surface 19 thereof. The protective material may consist of or include rigid plastic or metal sections, such that the layer acts essentially as a splint. Alternatively, the protective material may consist of or include packs that can be chilled or heated to provide hot and cold therapy to desired locations. Moreover, the protective material may be a thermally resistant material that protects against excessive hot or cold temperatures. The various types of protective layers may be readily added, removed or repositioned, as appropriate, to provide customized therapy and prophylactic protection.

Figure 8:
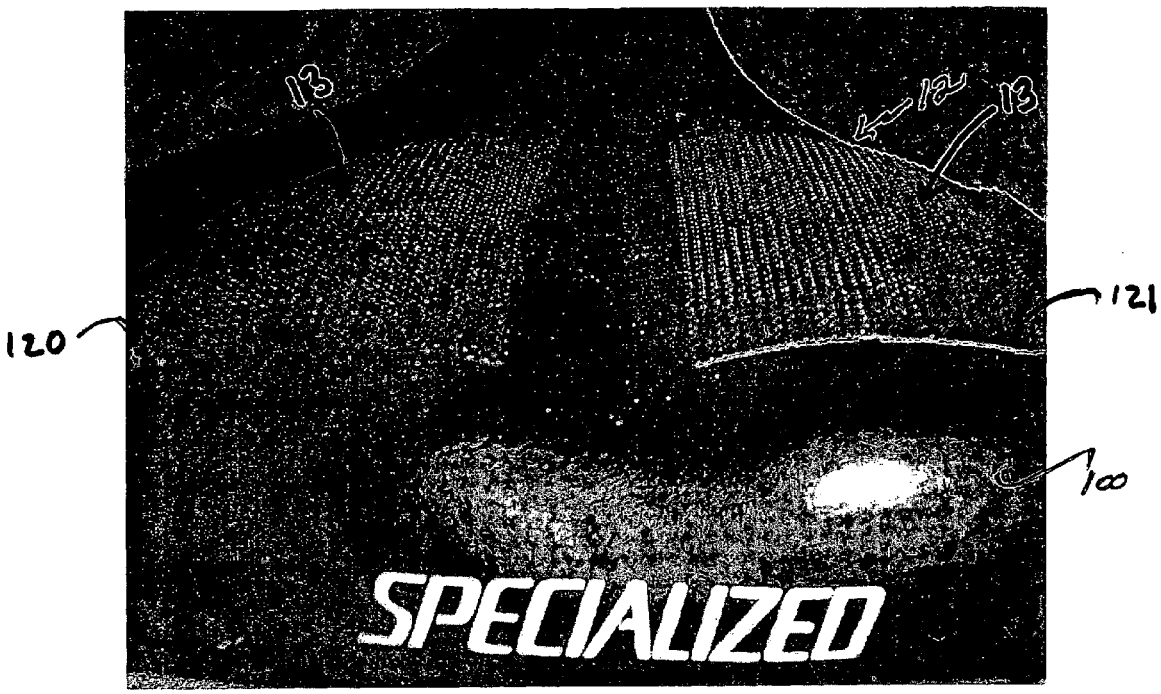
FIGS. 8–12 depict the protective pad assembly in use on a bicycle seat.

FIGS. 8–12 illustrate an alternative embodiment of the protective pad assembly 10. As shown in FIG. 8, the base layer 12 consists of two sections 120 and 121 that are attached by adhesive to a bicycle seat 100. The sections 120 and 121 are strategically located on portions of the bicycle seat that come in contact with previously injured or particularly sensitive areas of a given rider's body. The sections 120 and 121 each include, respectively, surfaces 13 that consist of the hooks of a two-part hook and loop fastener system.

Figure 9:
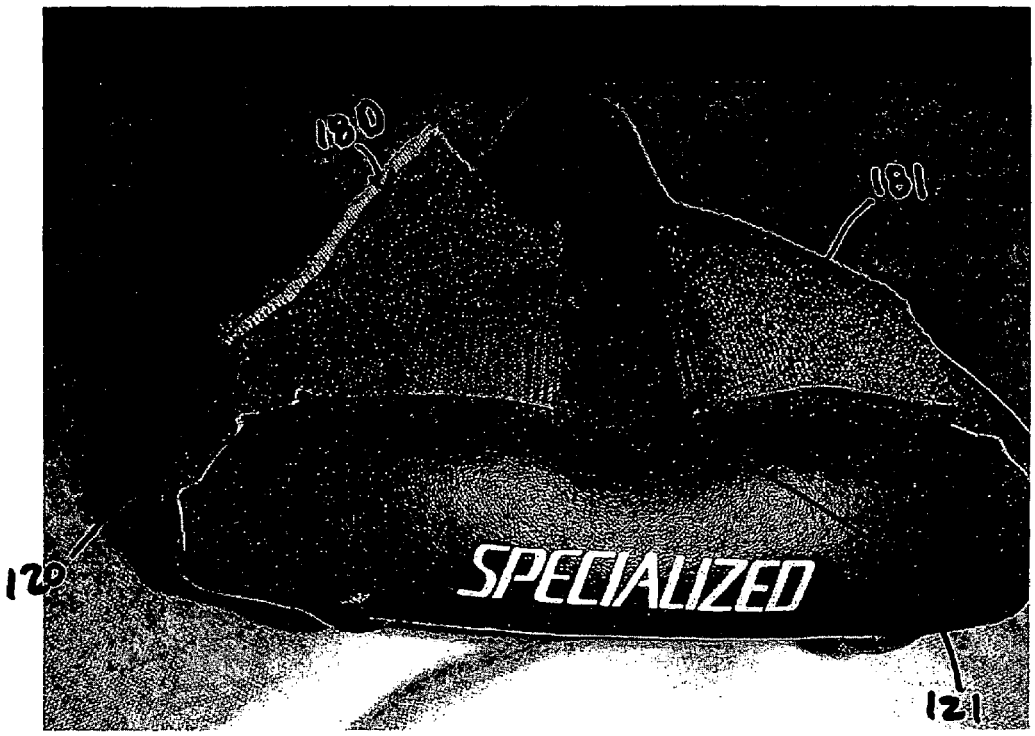

As depicted in FIG. 9, the first protective layer 18 is separated into two sections 180 and 181 that attach, respectively, to the sections 120 and 121 of the first layer. The surfaces 19 of the sections 180, 181 incorporate the loops of the hook and loop fastening system. Accordingly, the protective layer sections 180 and 181 attach directly to the corresponding first layer sections 120, 121.

Figure 10:
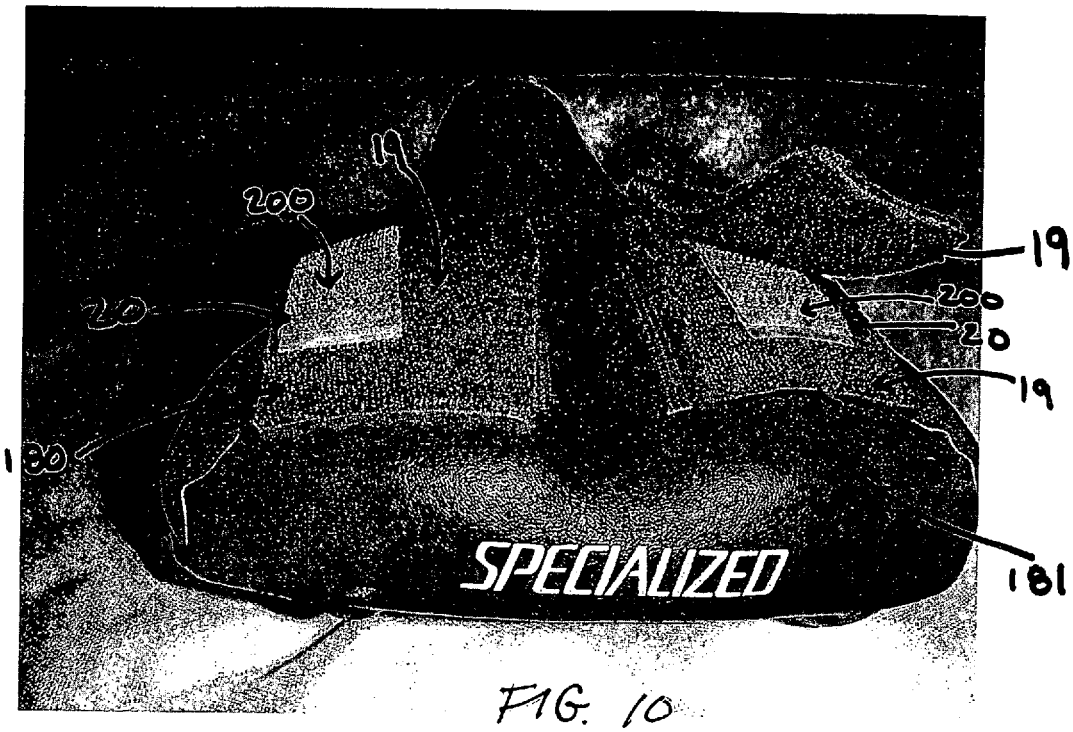

Referring now also to FIG. 10, fastening strips 20 are utilized to attach additional protective layers $\mathbf{18}_i$ to the assembly. The fastener strips 20 are double sided and include on each surface 200 hooks that mate with the loops that are incorporated into the surfaces 19 of the respective protective layers.

Figure 11:
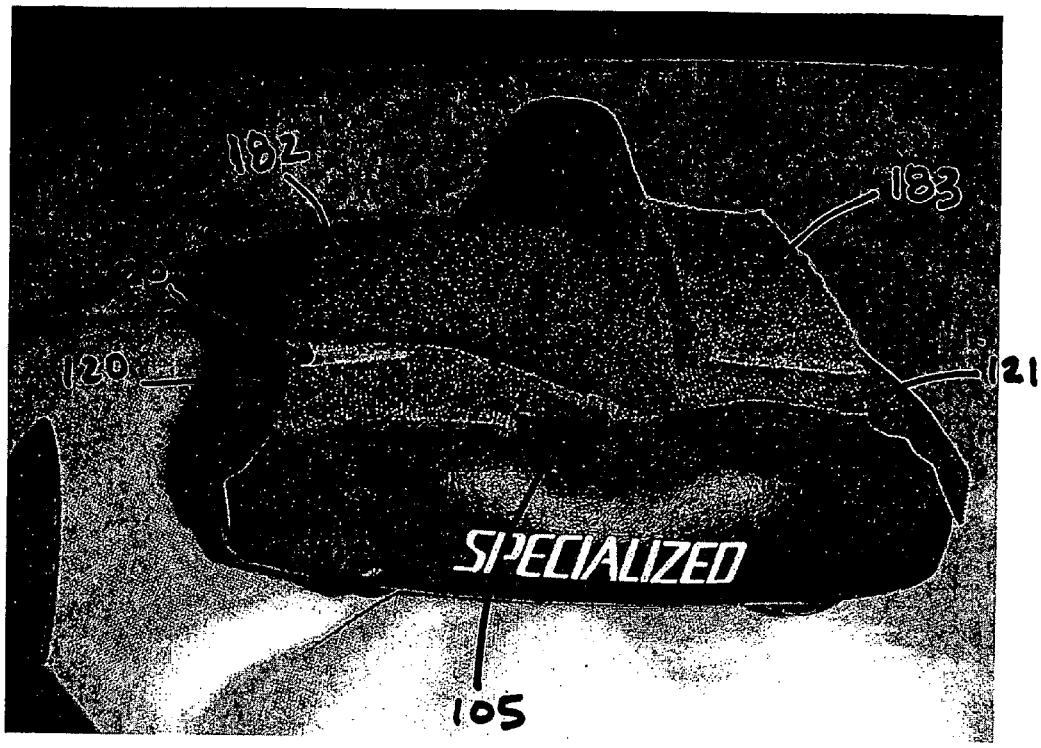

FIG. 11 depicts a second protective layer $\mathbf{18}_2$ as two sections 182 and 183. The section 183 is sized to correspond essentially to the size of the section 181 of the first protective layer. A second section 182 extends beyond the corresponding section 180 of the first protective layer 18, to provide a layer of padding in a gap 105 between the two sections 120, 121 of the first layer 12.

Figure 12:
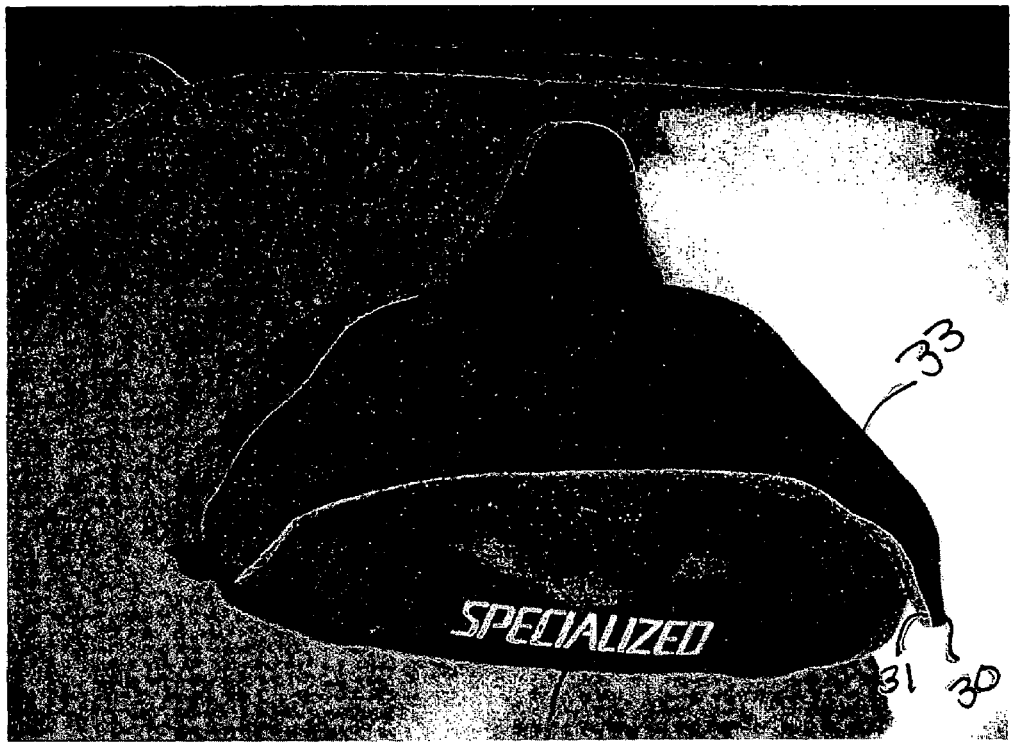

FIG. 12 illustrates a cover layer 30 that extends over the protective layers 18, to provide a smooth outer surface 33 to the assembly 10. The cover layer 30 includes an inner fastener surface 31 with fasteners that mate with the fasteners incorporated into the surface 19 of the protective layer $\mathbf{18}_2$. Thus, in the example, the inner surface 31 of the cover layer 30 consists of hooks that mate with the integral loops of the protective layer $\mathbf{18}_2$. The outer surface 33 of the cover layer 30 is made from a smooth material, such as nylon or silk.

Figure 13:
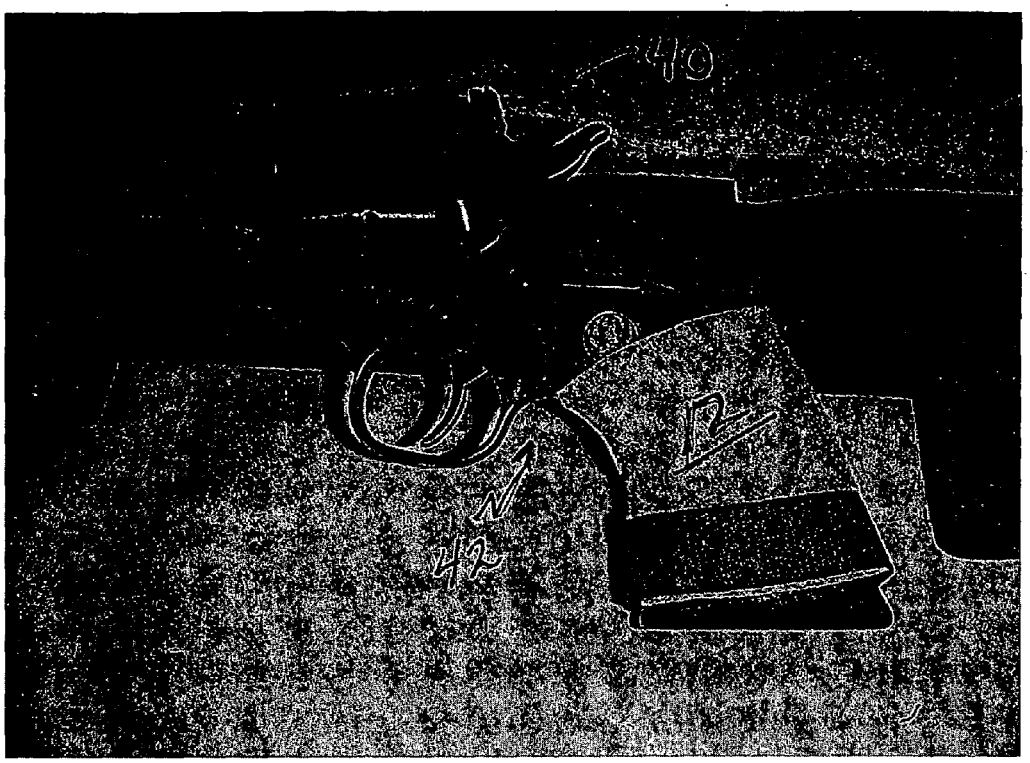
FIG. 13 depicts the protective pad assembly in use on a handgun.

FIG. 13 illustrates the protective pad assembly in use on a handgun 40. As illustrated, the base layer 12 is secured around a grip end 42 of the gun. Various protective layers 18 may then be added to the base layer in the manner discussed above to provide customized padding and grip at locations that, for the given user, tend to irritate injured or particularly sensitive areas of the user's hand. The protective layers may be readily removed or repositioned, to customize the gun grip for another user.

Figure 14:
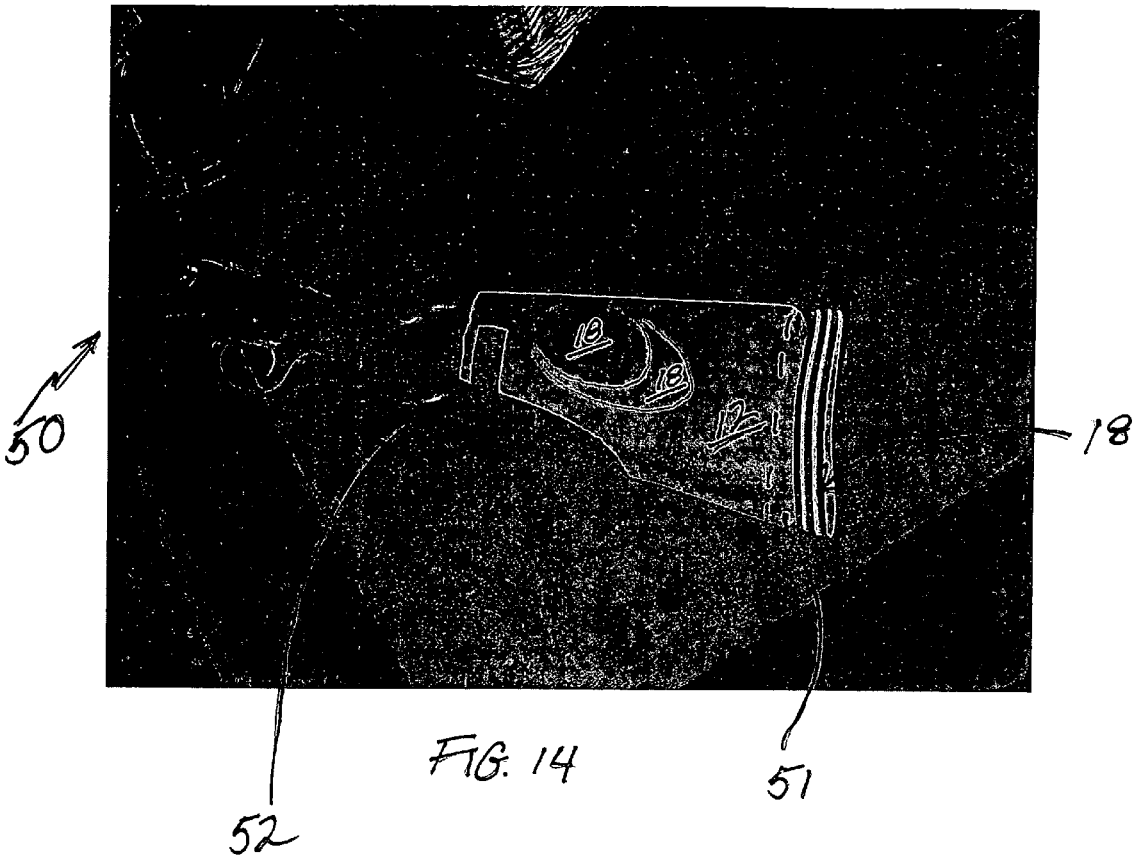
FIGS. 14–15 depict the protective pad assembly in use on a rifle.
Figure 15:
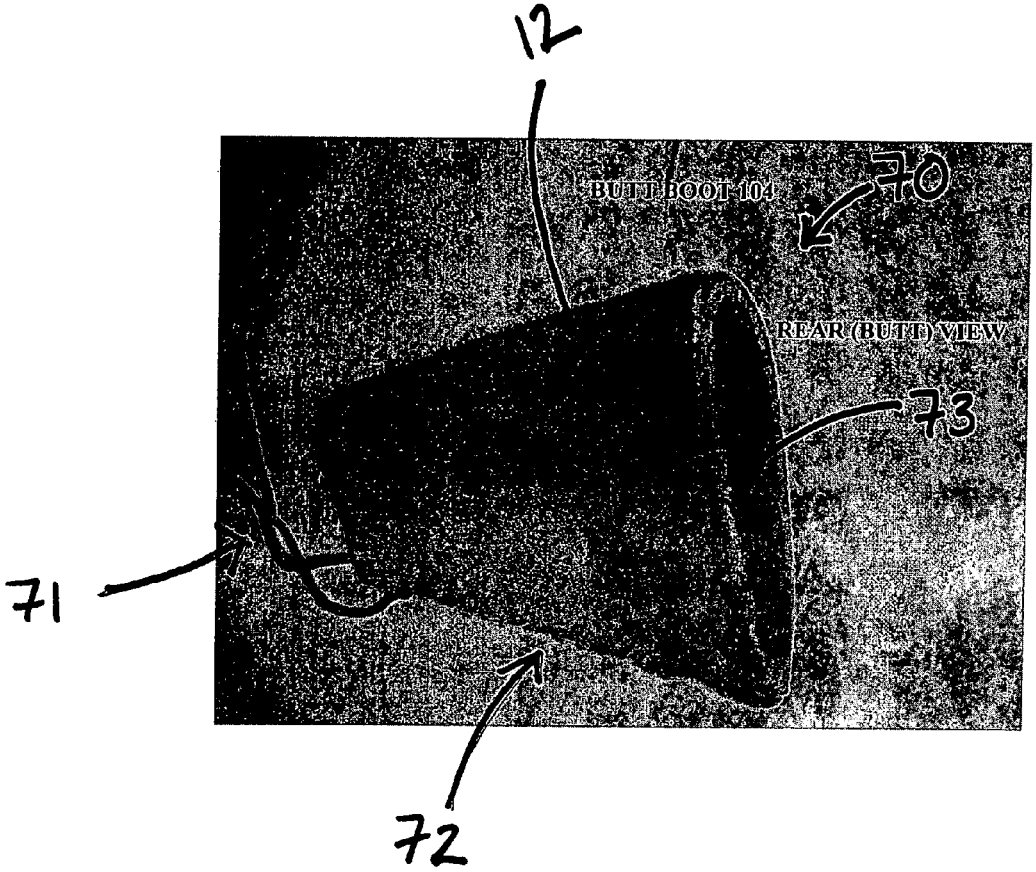

FIGS. 14–15 illustrate the protective pad assembly in use on a rifle 50. The base layer 12 fits over all or a portion of the butt end of the stock 52, to provide a fastener surface on which may be attached protective layers 18 that are sized and positioned to provide customized padding to the inner or outer surfaces of the base layer along the sides and/or butt end of the rifle. The base layer 12 may instead be made of a rigid material that incorporates the fasteners, with the base layer replacing an end plate 51 which is depicted by dashed lines in the drawing. The protective layer or layers 18 can then be secured to the fasteners, to pad the end of the rifle as desired.

FIG. 15 illustrates an exemplary protective cover 70 that fits over the butt of the rifle. The protective cover includes a "boot" section 72 disposed around the butt of the rifle and an end piece 73 adapted to cover the end of the rifle. The boot section may be constructed by wrapping a portion of the base layer 12 around the butt of the rifle and securing the base layer around the butt using a securing means, such as a lace 71. As shown, the end piece 73 is constructed separately from the boot section 72, although it is expressly contemplated that in other embodiments the end piece may be an integral element of the boot section. The end piece can be formed of a rigid or flexible material appropriately shaped to cover the end of the rifle. The inner or outer surfaces of both the boot (side) section 72 and the end (butt) piece 73 provide fastener surfaces on which may be attached one or more protective layers 18 that are sized and positioned to provide customized padding to the sides and end of the rifle.

Figure 16:
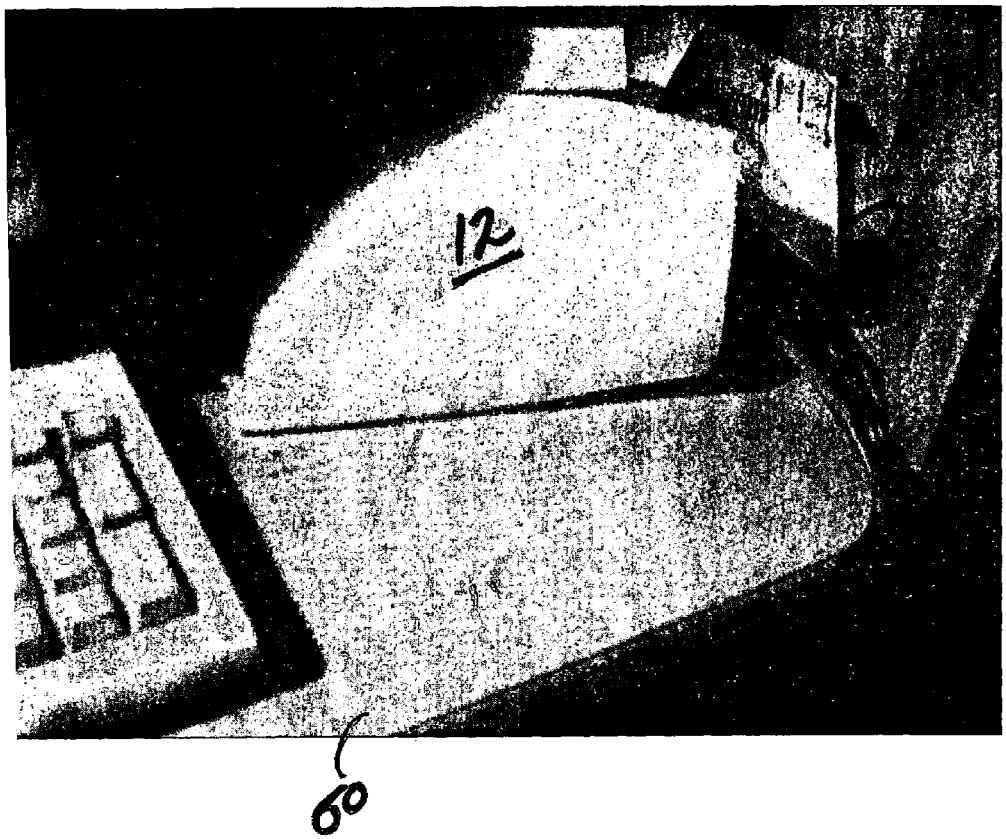
FIGS. 16–17 depict the protective pad assembly in use as a mouse pad.
Figure 17:
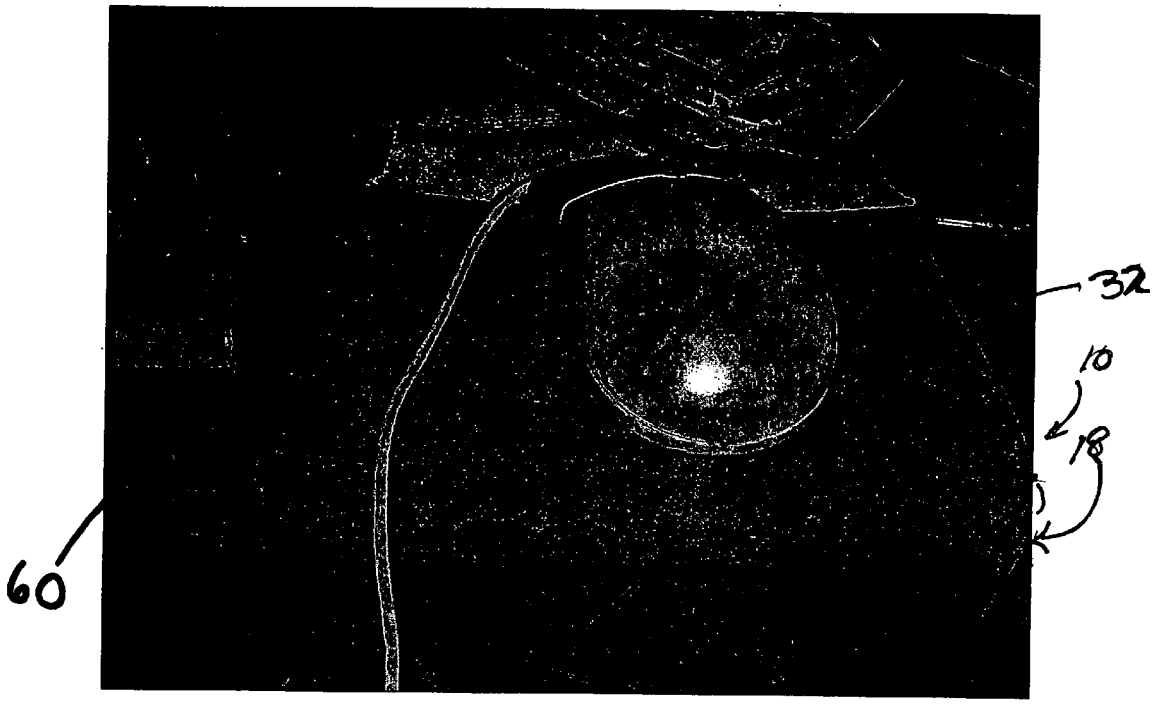

FIGS. 16 and 17 illustrate the protective pad assembly in use as a mouse pad. The protective pad assembly 10 includes a base layer 12 that is secured to a work surface 60. The protective layers 18 (indicated by dashed lines) and the cover layer 30 are then attached in the manner discussed above, to provide customized padding to protect a user from aggravating a carpal tunnel condition. The protective layers are thus added to the first layer at positions that come in contact with the user's wrist, with the remaining flat portion of the assembly available for manipulation of the mouse. The outer surface 32 of the cover layer 30 is made of material that provides an appropriate contact surface for the mouse. As also discussed, the protective layers 18 can be removed, repositioned, or new layers can be added to accommodate the needs of various users or of a given user over time.

Figure 18:
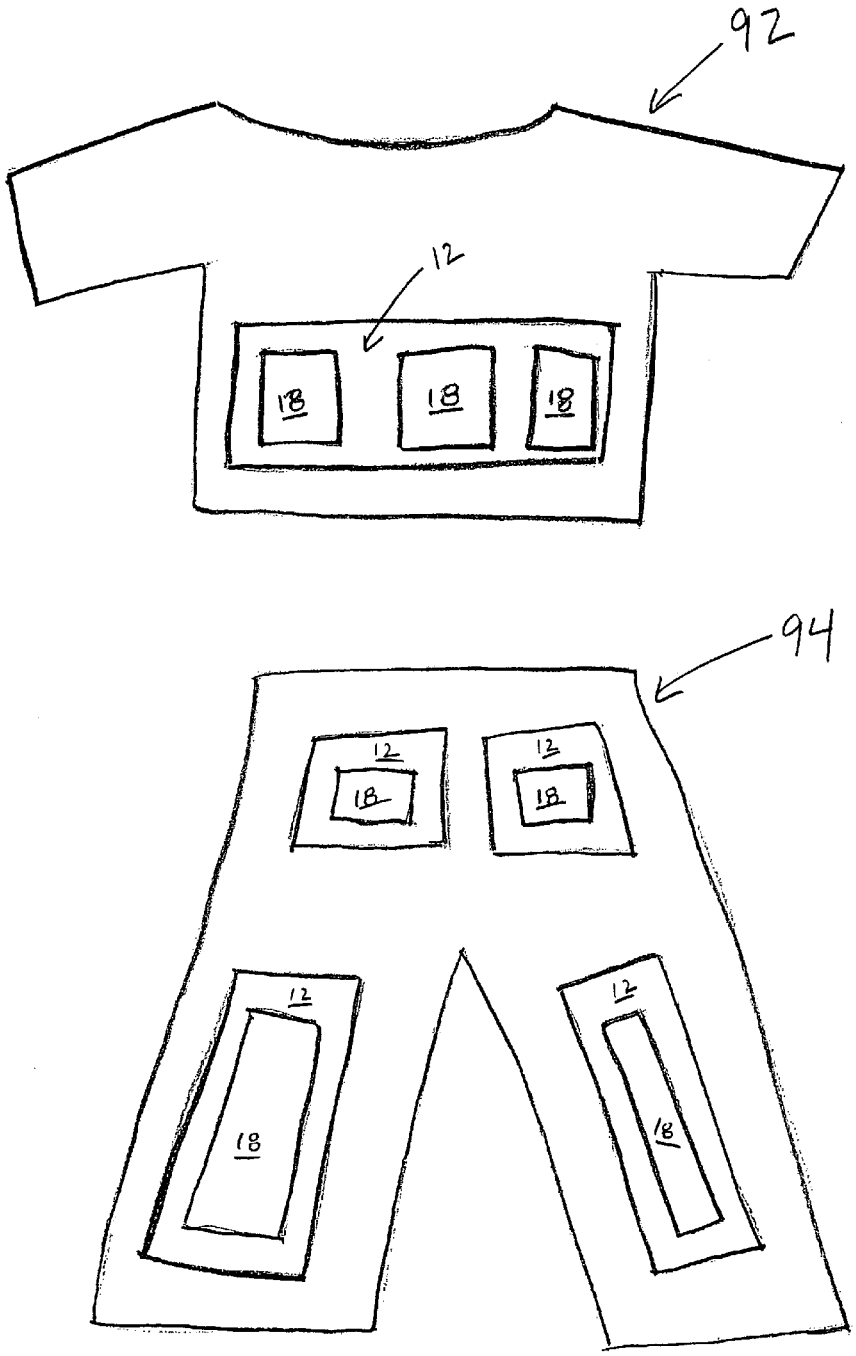
FIG. 18 depicts the protective pad assembly in use on clothing.

FIG. 18 illustrates the protective pad assembly in use on clothing. The base layer 12 may be sewn, or otherwise attached, to one or more selected areas on a shirt 92 or pants 94. Alternatively, the base layer 12 may be directly incorporated into the selected areas of clothing. For instance, the shirt 92 or pants 94 can be made of a base layer that is a loop material, with or without intrinsic padding, depending on the application. One or more protective layers 18 may be fastened to the inner or outer surface of the base layer 12 on the clothing to provide padding that protects the wearer. The protective layers 18 can be added, removed or repositioned on the base layer 12 so as to protect sensitive or injured areas of the body, or areas that are susceptible to injury. Accordingly, the size and number of protective layers 18 fastened to different areas of the base layer may depend on the amount of comfort or protection desired for a particular activity. For instance, the distribution of protective layers 18 positioned on the shirt 92 and pants 94 will likely be different when horseback riding than when playing rugby.

Figure 19:
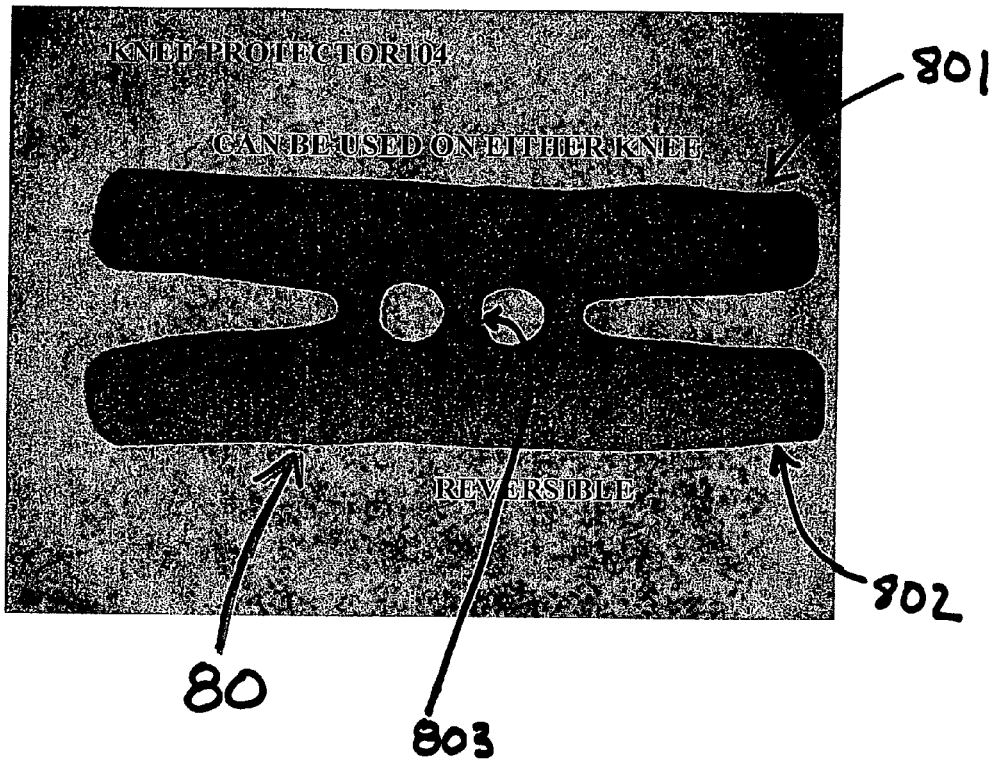
FIGS. 19–20 depicts the protective pad assembly in use on a knee.
Figure 20:
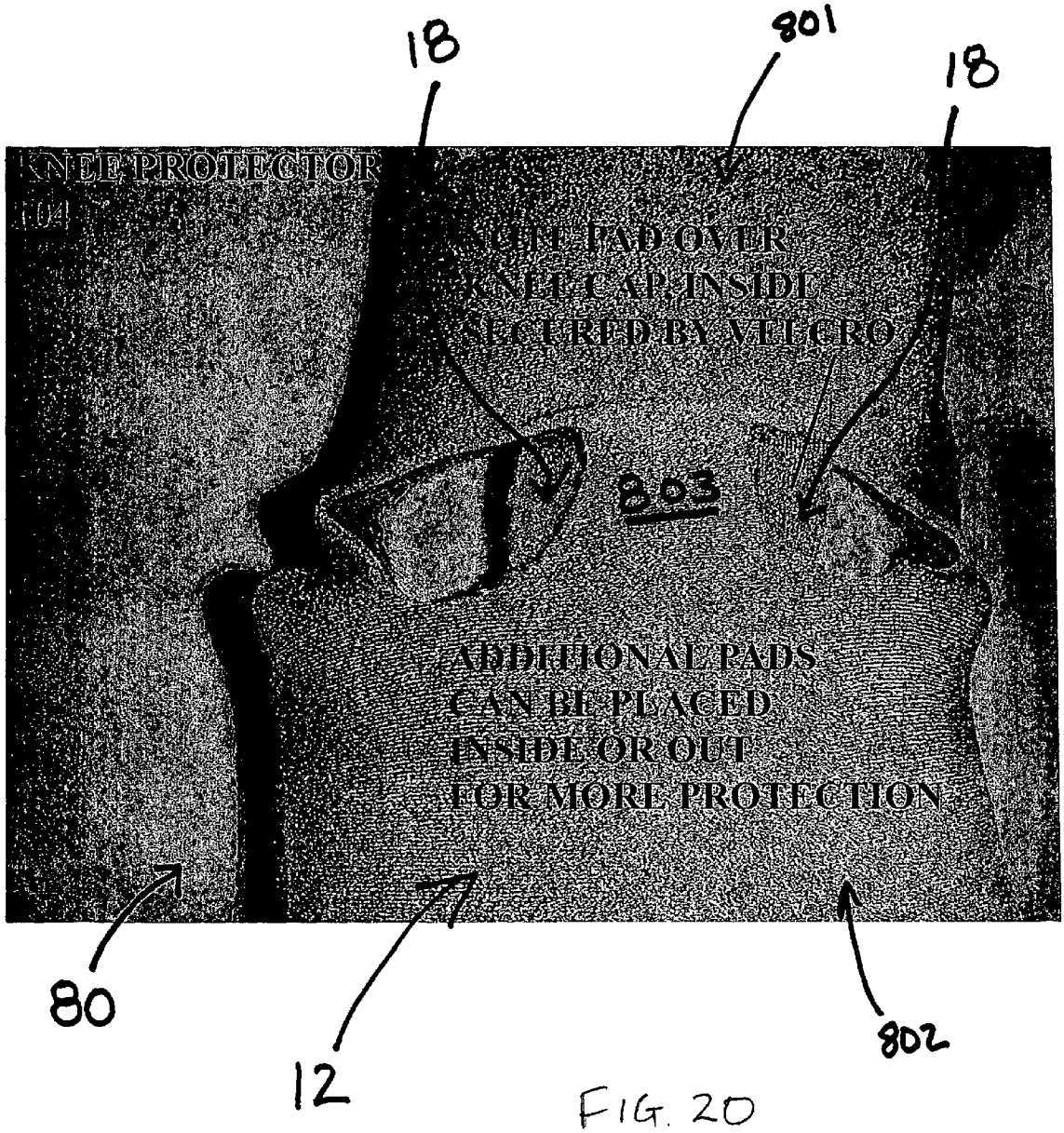
Figure 1:
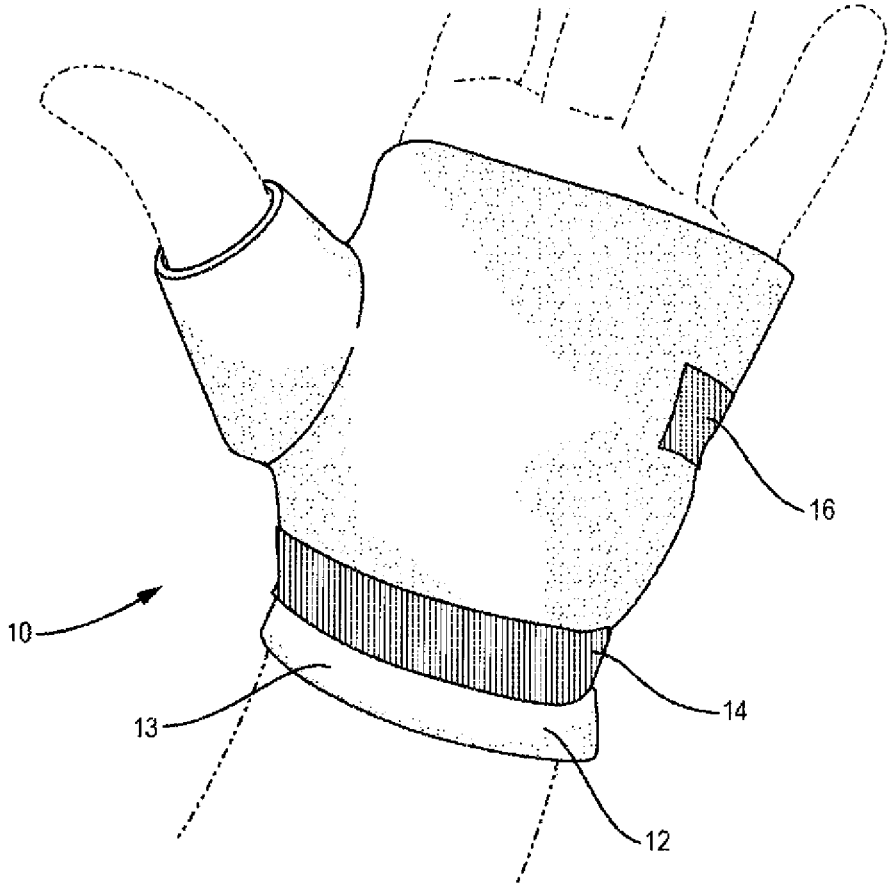
Figure 2:
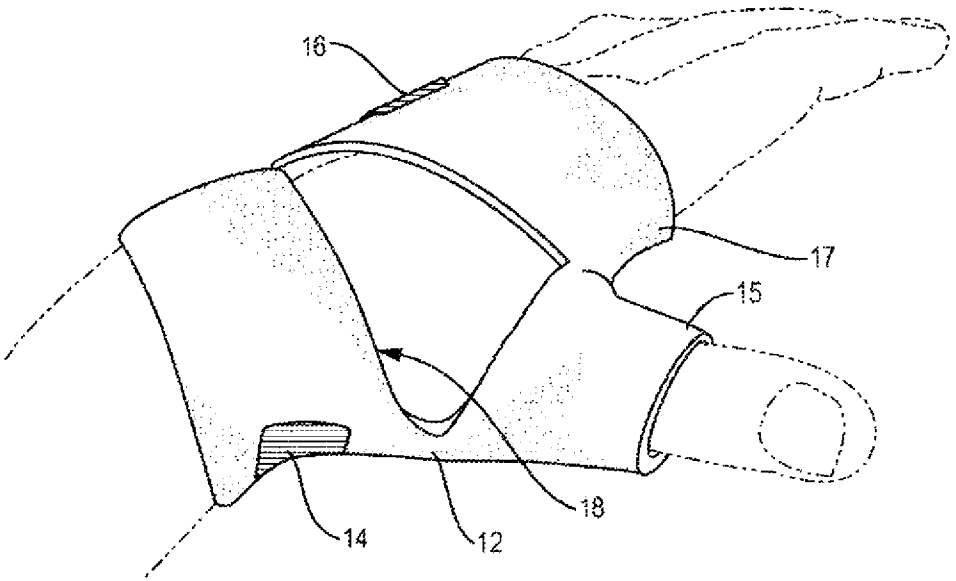
Figure 3:
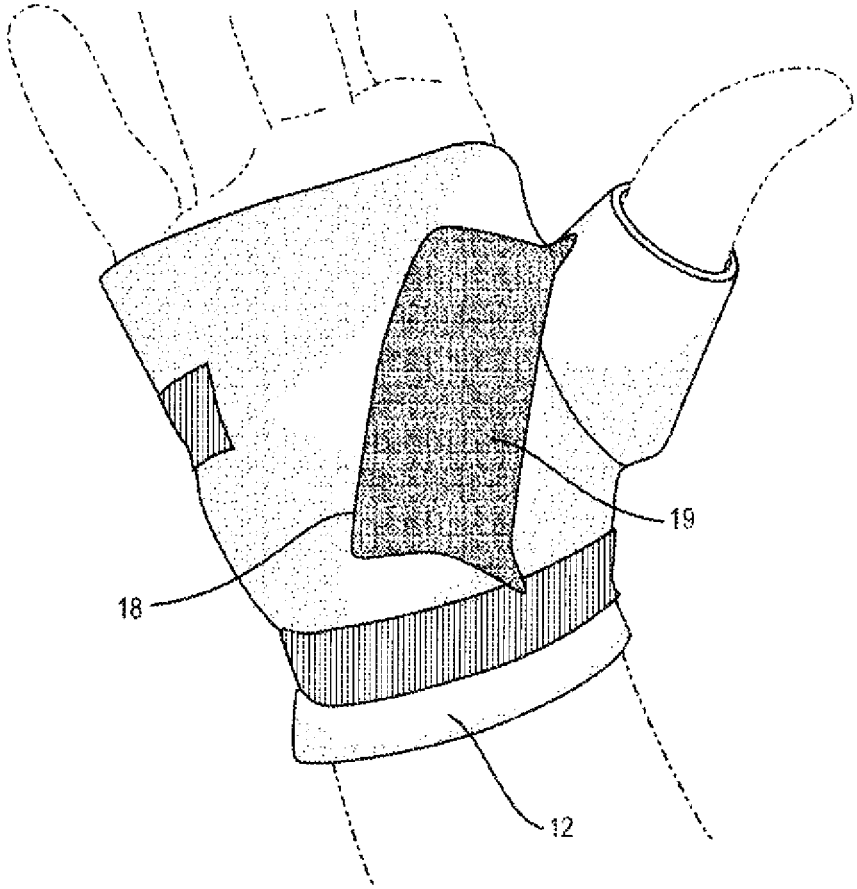
Figure 4A:
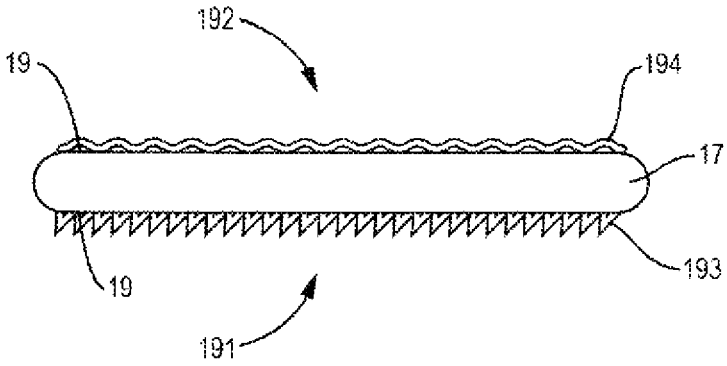
Figure 4B:
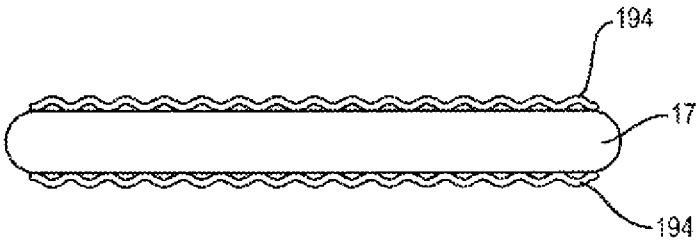
Figure 4C:
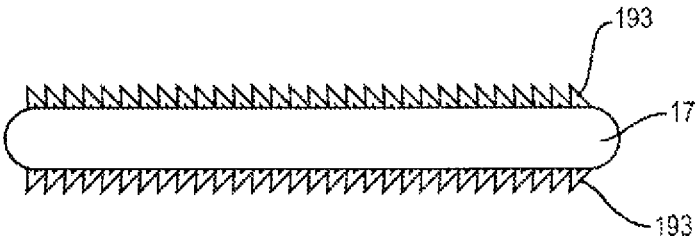
Figure 5:
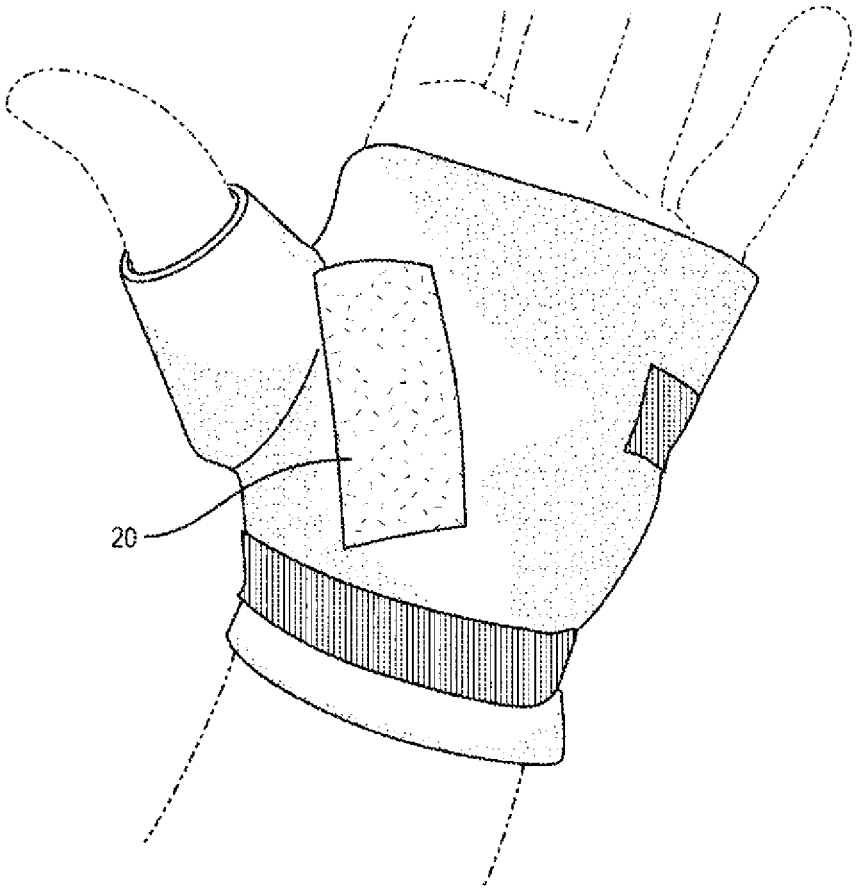
Figure 6:
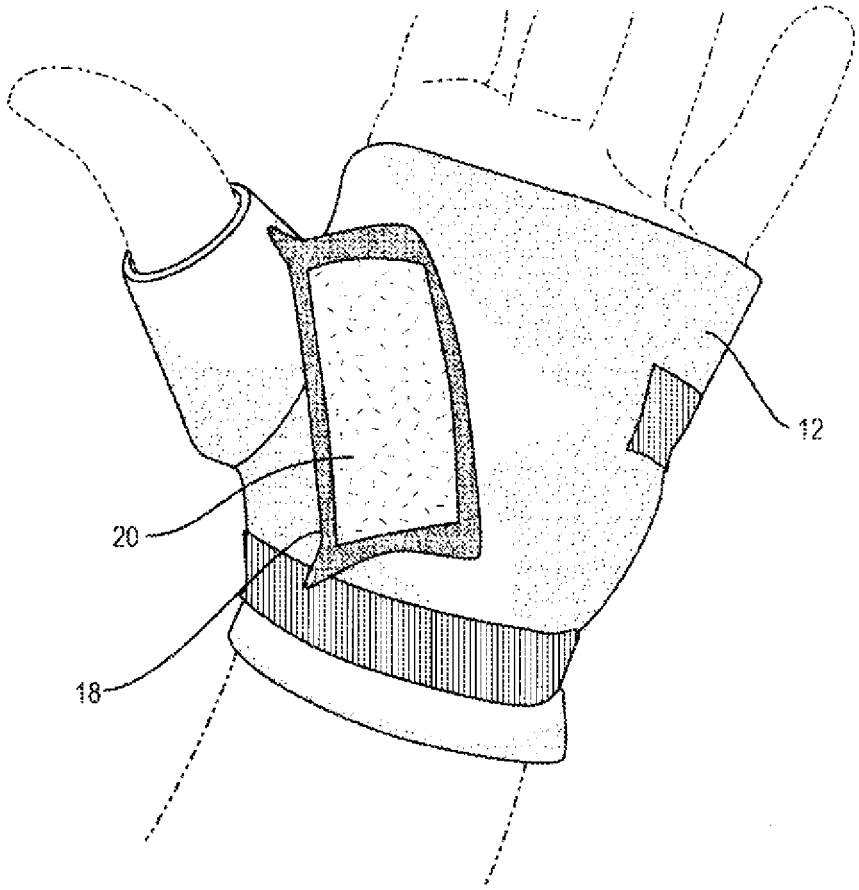
Figure 7:
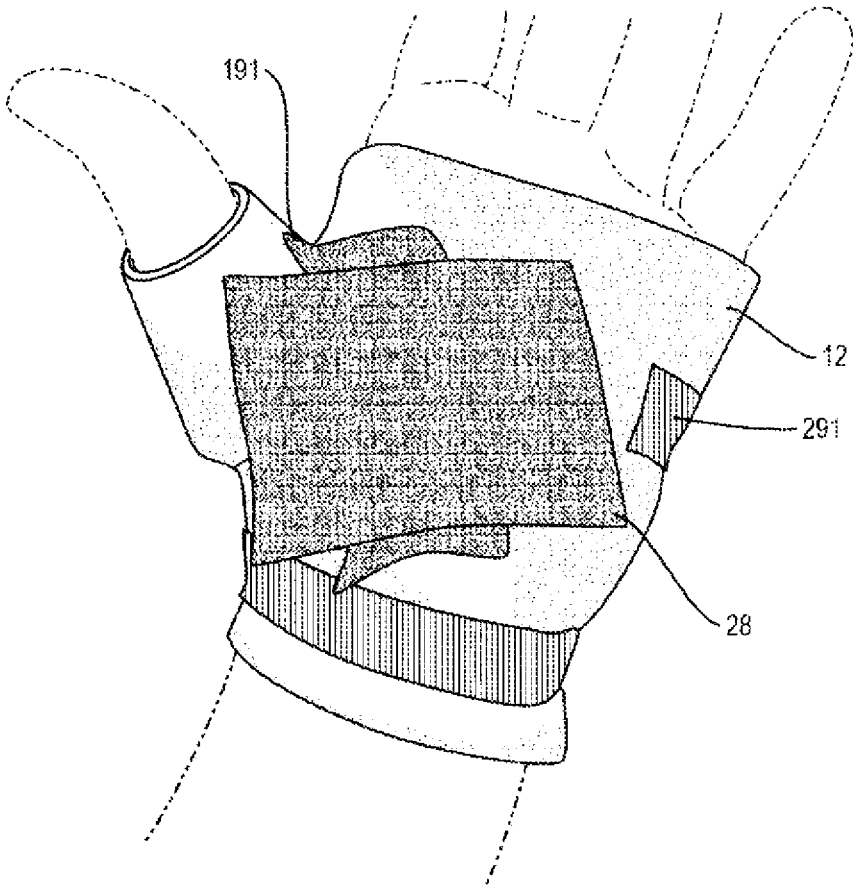
Figure 8:
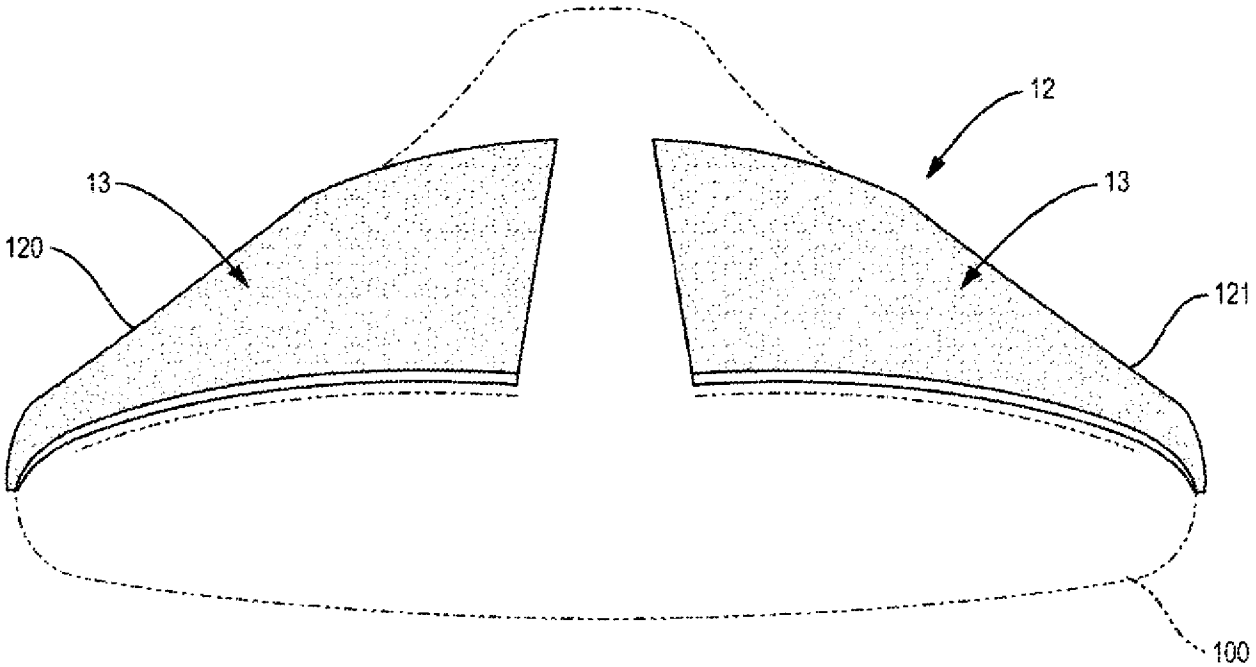
Figure 9:
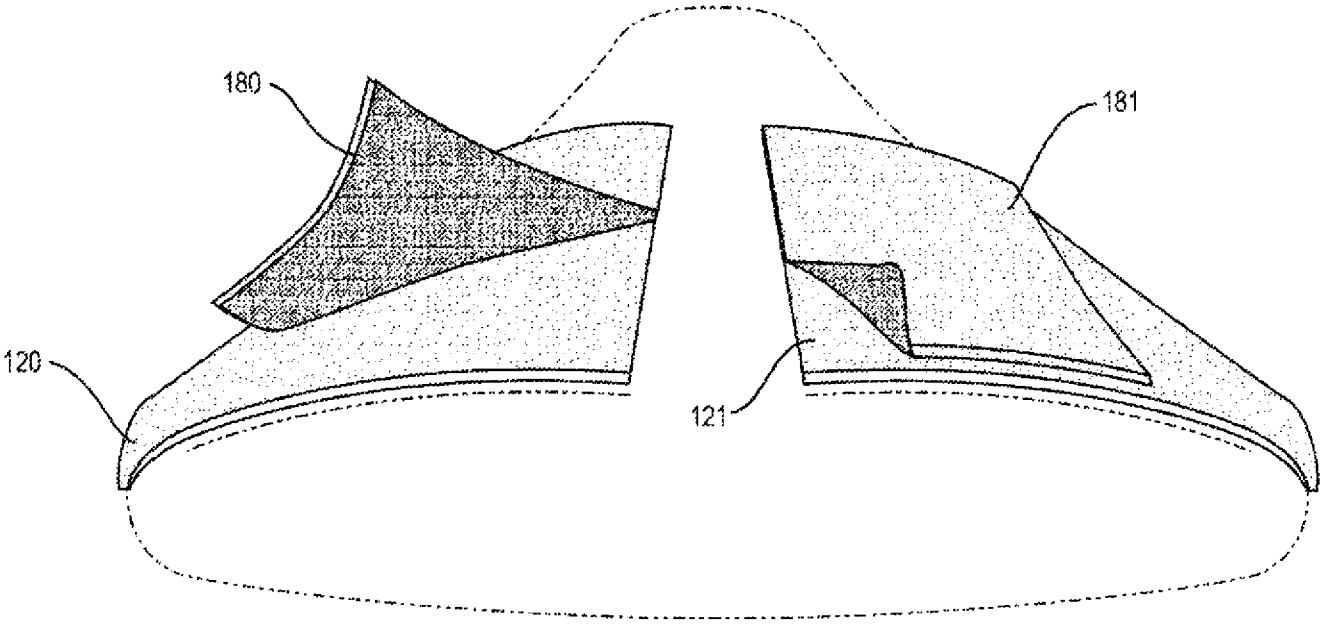
Figure 10:
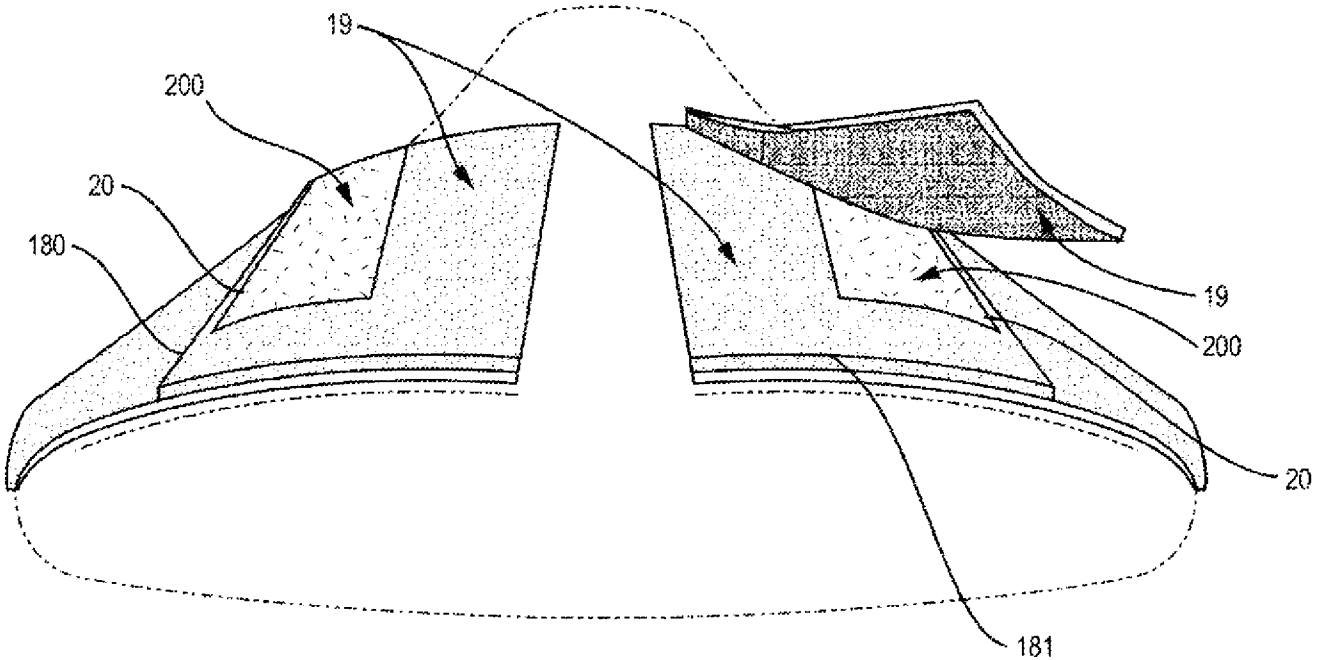
Figure 11:
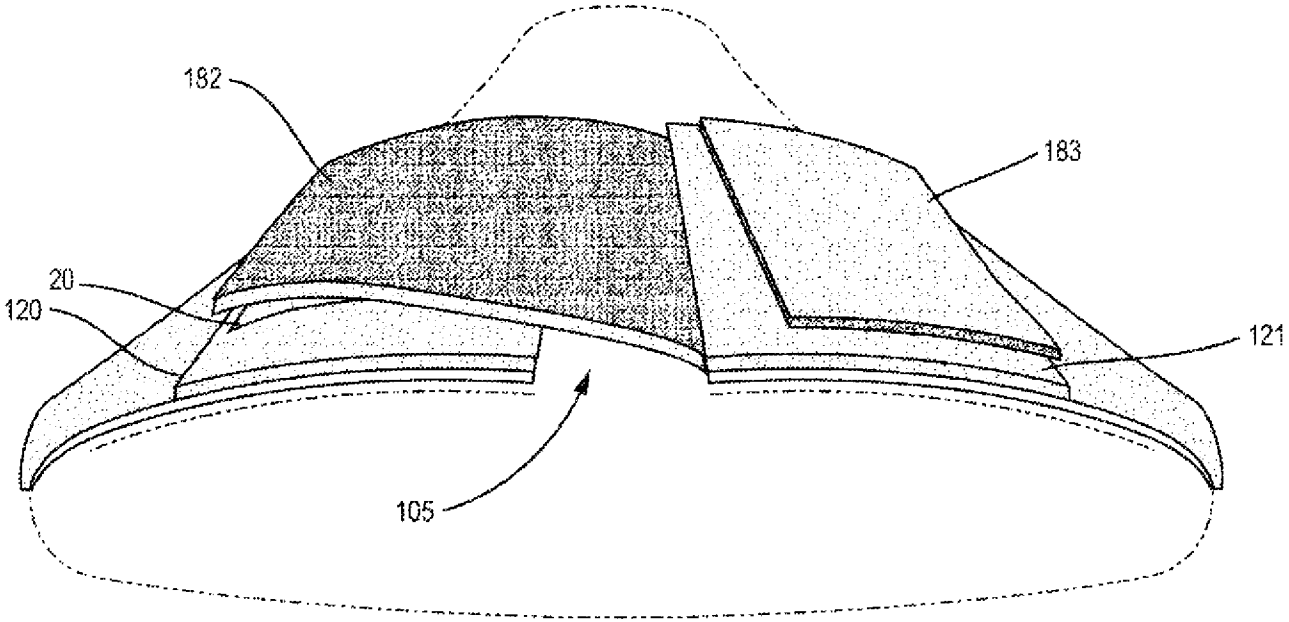
Figure 12:
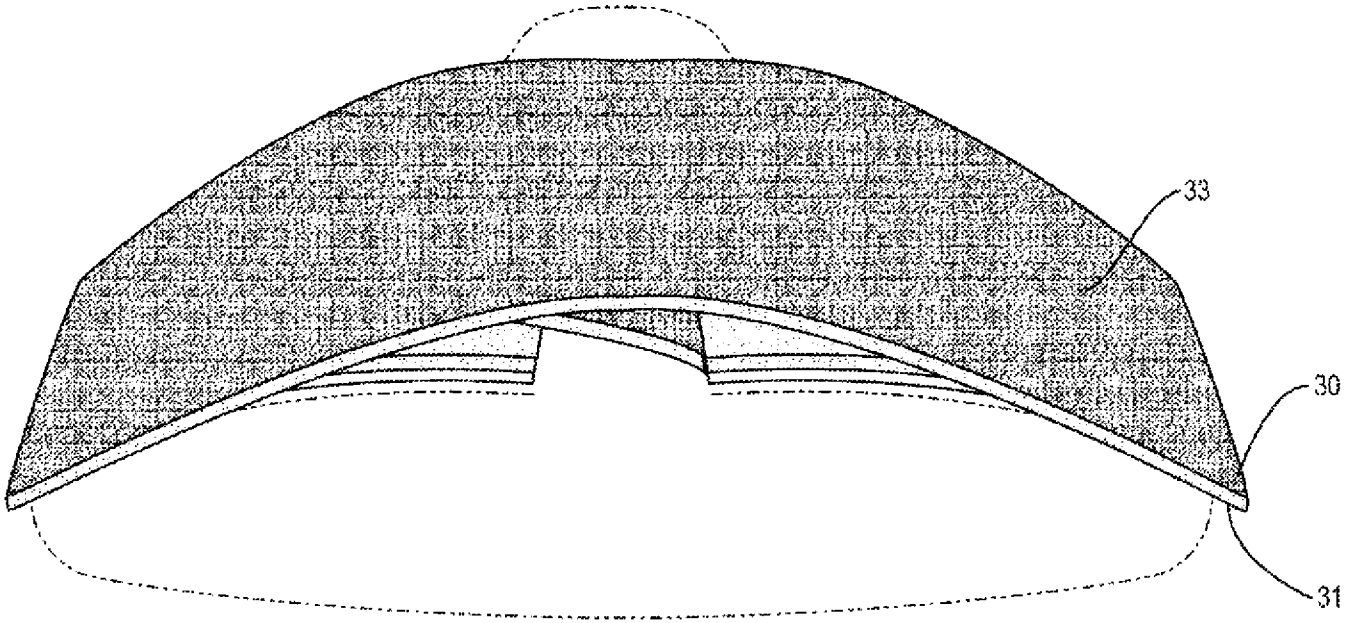
Figure 13:
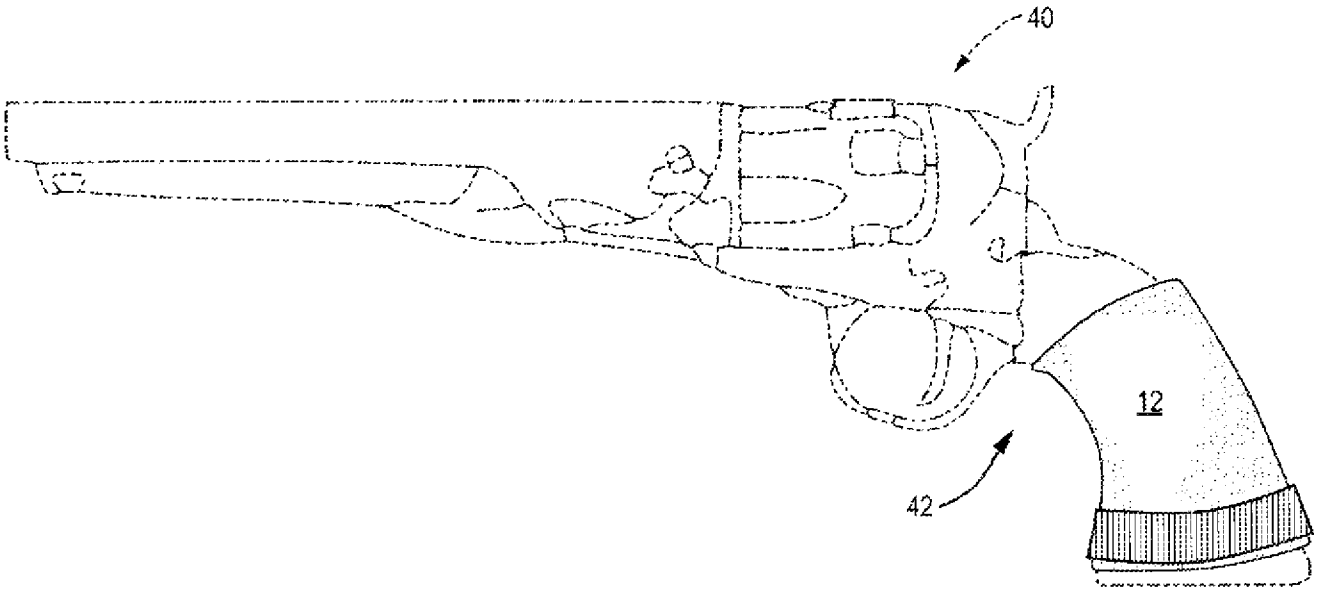
Figure 14:
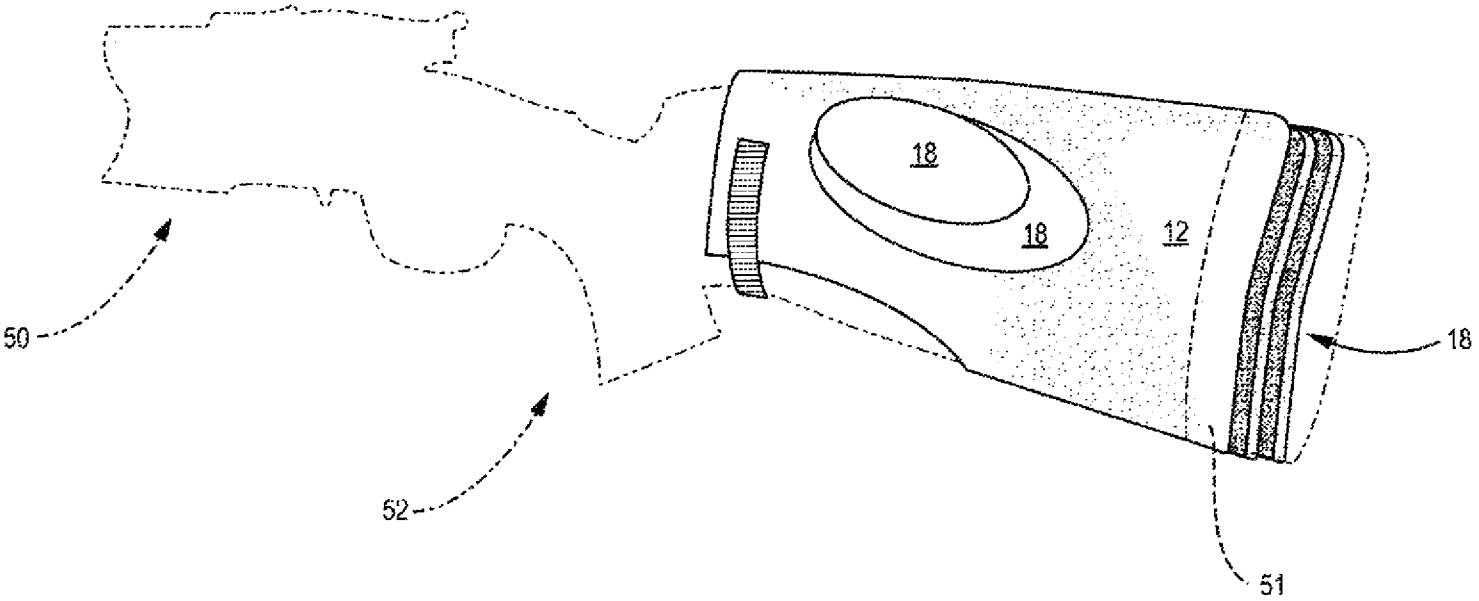
Figure 15:
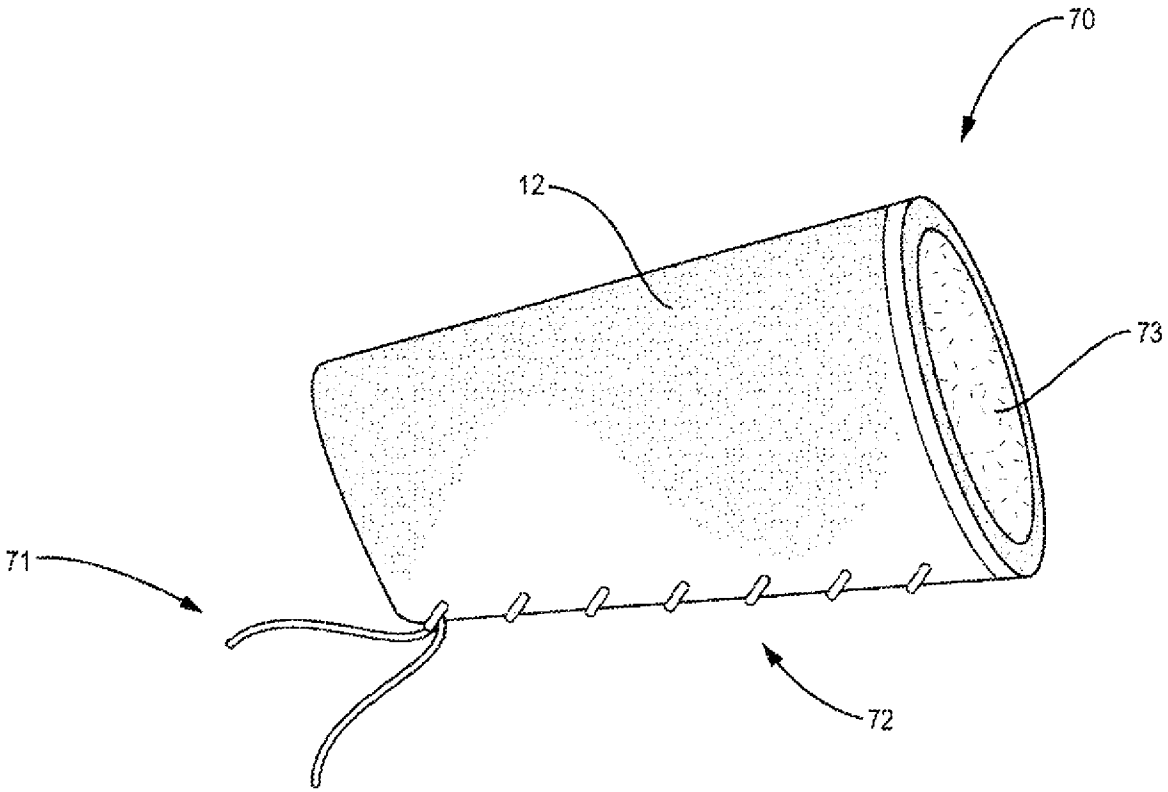
Figure 16:
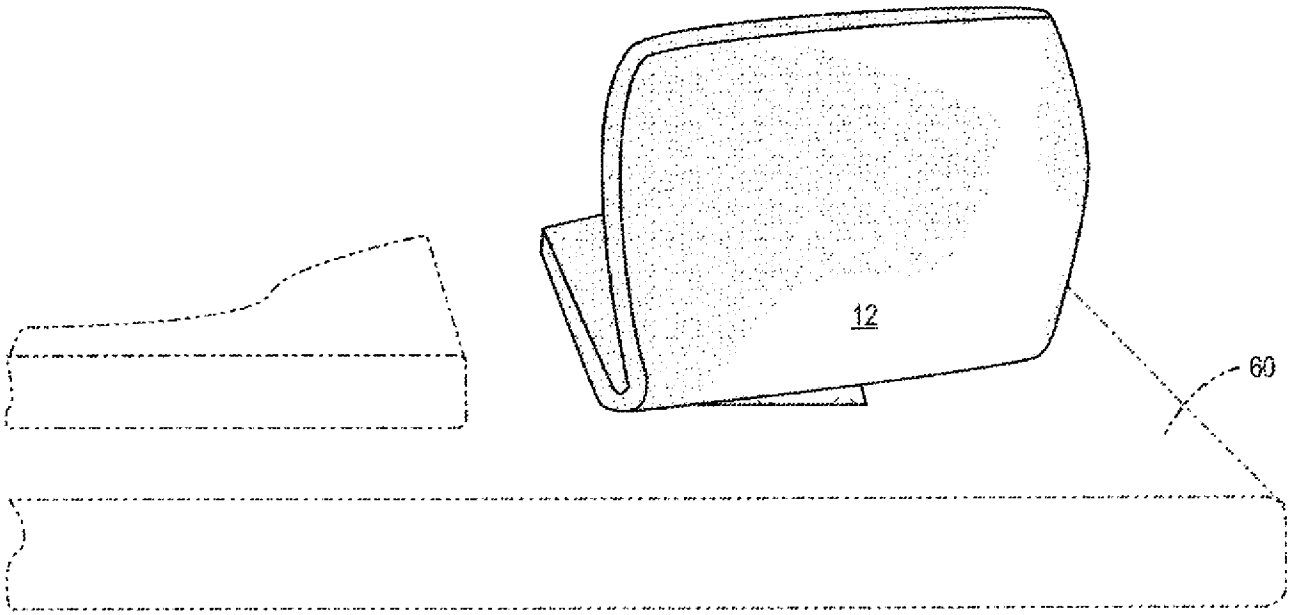
Figure 17:
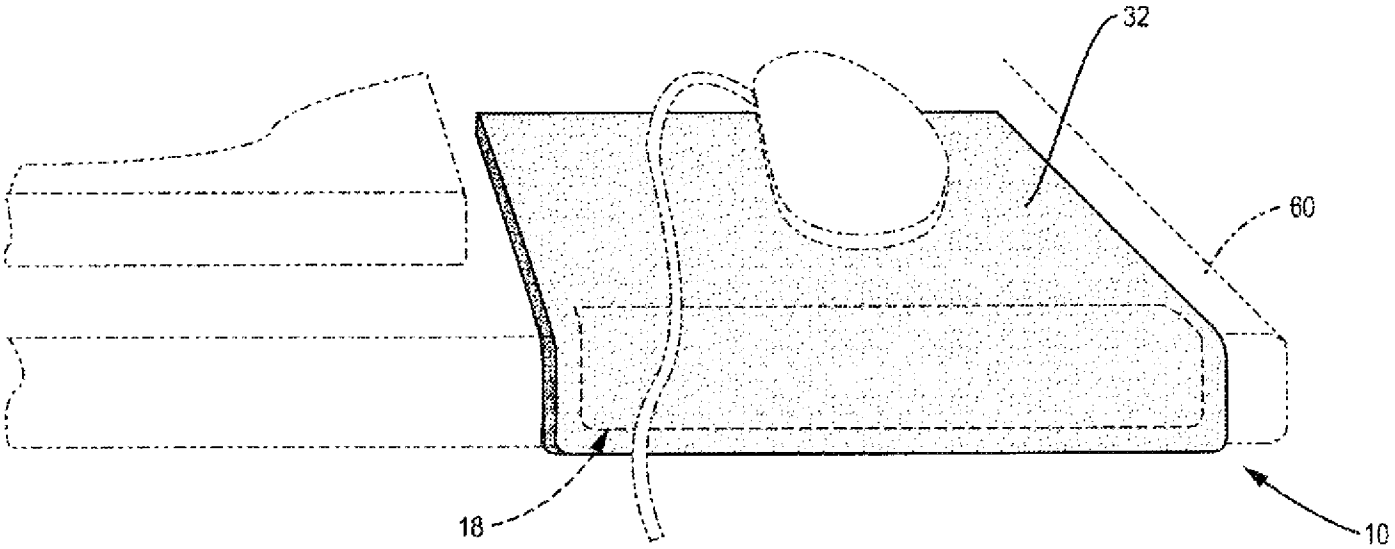
Figure 18:
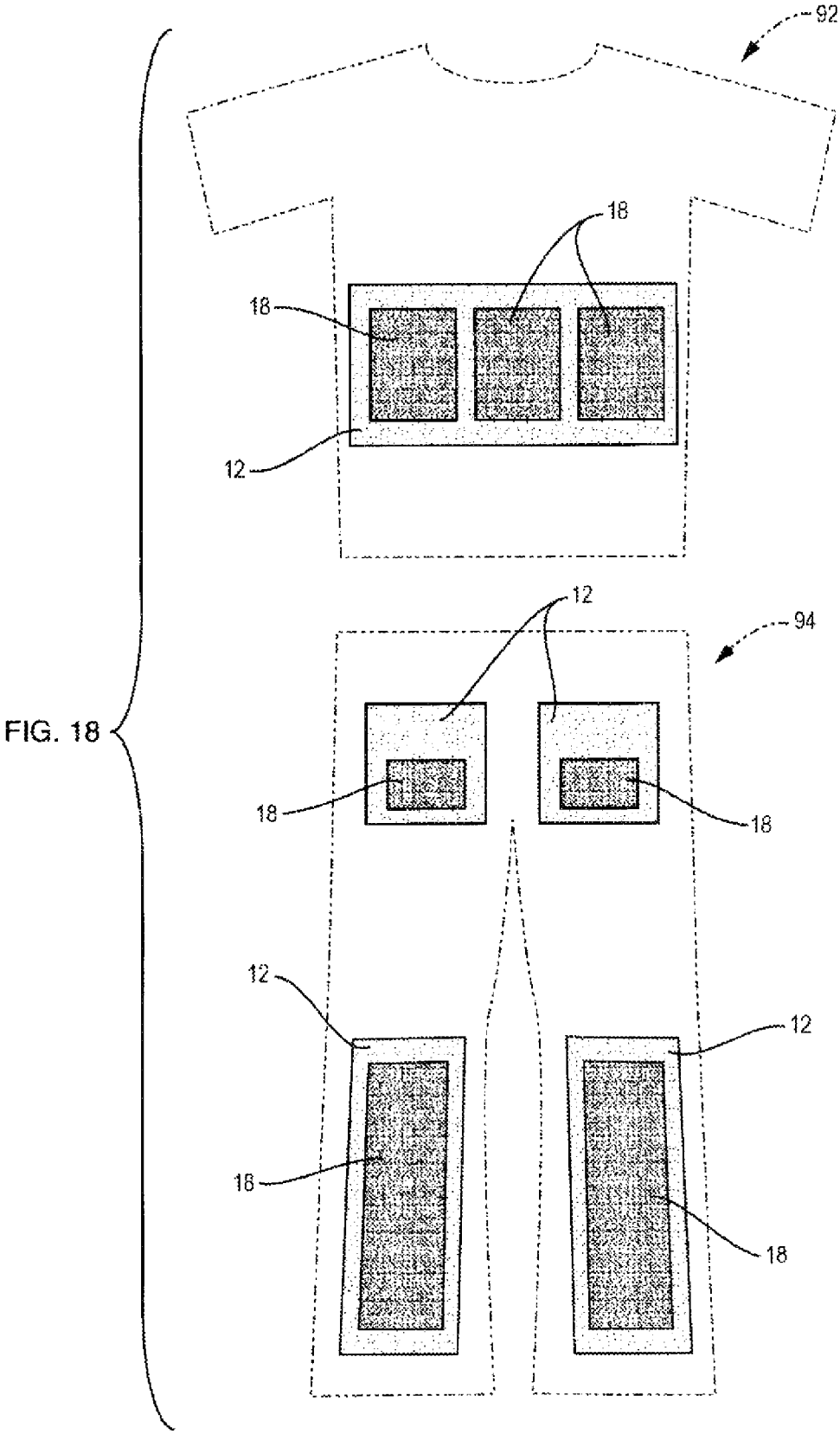
Figure 19:
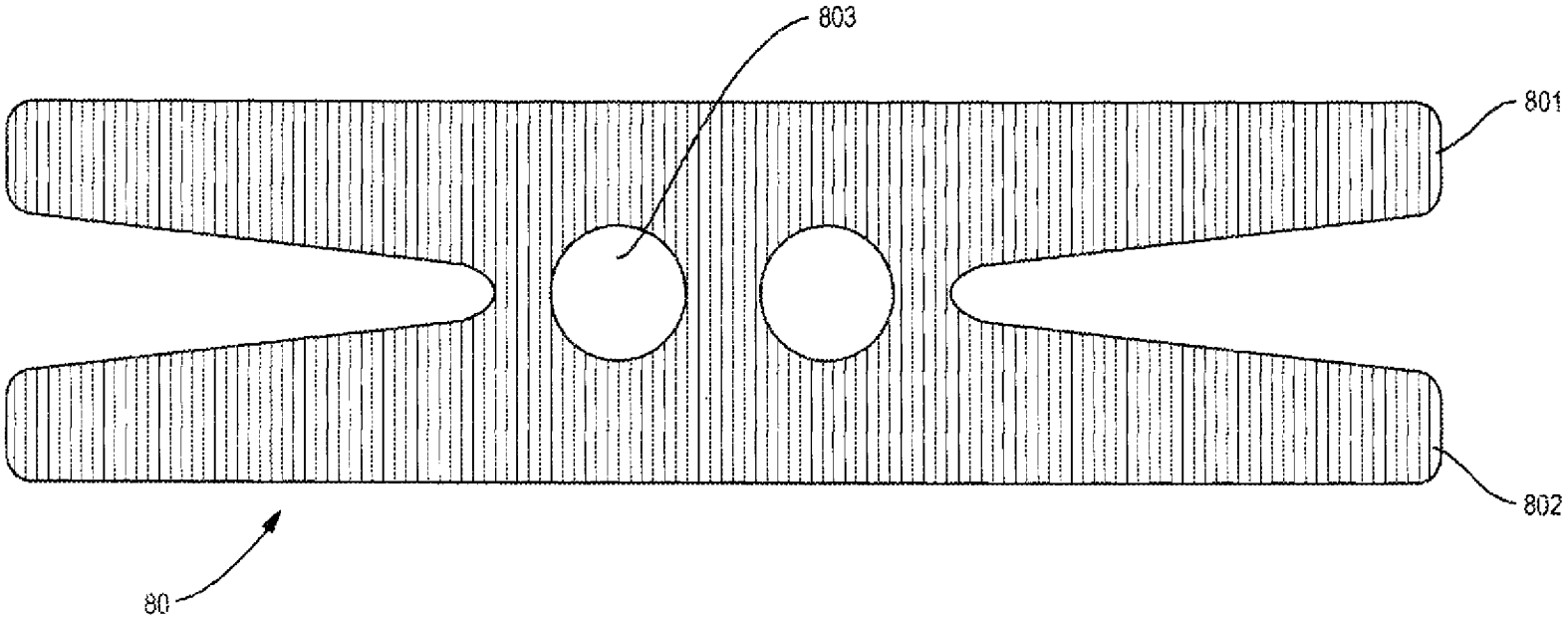
Figure 20:
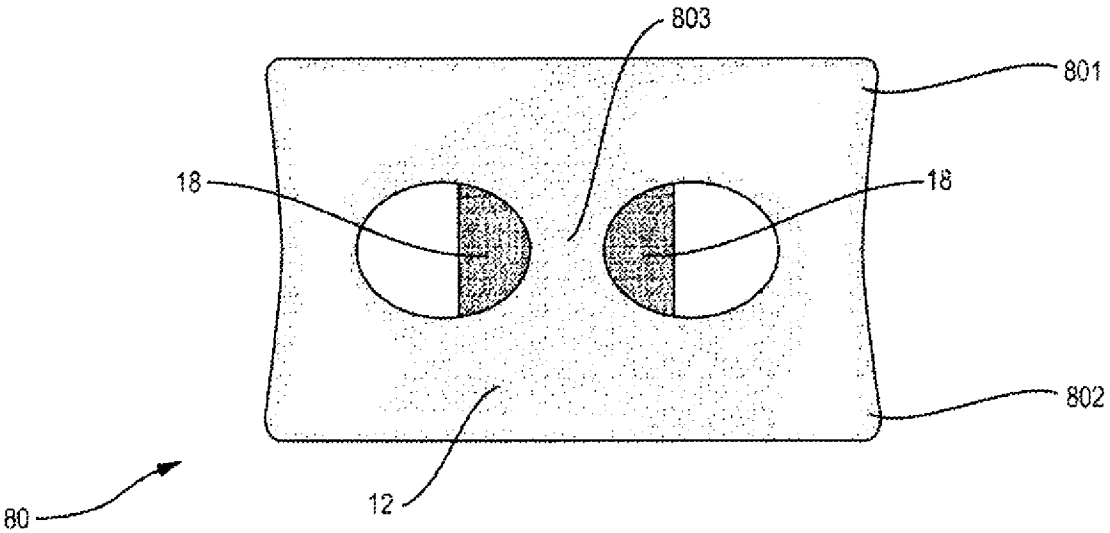

FIGS. 19 and 20 illustrate the protective pad assembly in use as a knee protector 80. The knee protector may be constructed from a base layer 12 that is shaped to include integral straps 801 and 802 that are connected by one or more "bridge" portions 803. When the knee protector is positioned over a knee, the straps 801 and 802 are respectively wrapped above and below the knee, i.e., around the thigh and calf, and secured by fastening means positioned at the end of the straps. Each strap may employ a hook and loop fastener system whereby hooks positioned at one end of a strap mate with loops located at the other end of the strap, thereby securing the strap around the leg. Further, at least one surface of the base layer 12 includes fasteners used in a two-part fastener system, such as a hook and loop fastener system. Accordingly, protective layers 18 can be strategically fastened to the base layer 12 to provide padding, e.g., over an injured area of the knee. For instance, as shown in FIG. 20, one or more of the protective layers 18 may be fastened to either an inner or outer surface of the bridge portion 803.

The foregoing has been a detailed description of illustrative embodiments of the invention. Various modifications and additions can be made without departing from the spirit and scope of the invention. For example, while the drawings depict two protective layers, the pad assembly may include any number of protective layers. Each protective layer may consist of one or more sections, with the sections positioned at desired locations to provide customized protection to injured or vulnerable areas of the body.

The protective layers may be cut from large sheets, in sizes that accommodate a given user's needs. Alternatively, the protective layers may be stamped commercially from large sheets, to provide a user with an array of sizes. Additionally, the protective layers may have varying amounts of padding, i.e., varying thicknesses, to provide a user with the flexibility of providing a desired amount of padding to various locations.

The integral fasteners incorporated into the protective layers 18 may be constructed by shaping the surfaces of the protective material, for example, closed cell foam, to produce the loops and/or hooks. The integral fasteners may instead be constructed of material that is permanently affixed to, for example, the padding, by gluing or other known techniques.

In addition to the uses discussed above, the protective pad assembly may be used to provide customized protection in shoes, hiking boots, ski boots, or other wearing apparel. Further, the protective pad assembly may be used in sports equipment, such as the chest protectors that are worn in baseball, hockey or other sports, or in gloves or mitts used in various sports, and so forth, to provide customized protection. The assembly thus eliminates the need for time consuming and often costly adjustments to sporting equipment, footwear and so forth, and also provides the flexibility to allow for the rearranging of the protective padding to accommodate different users or the same user with new injuries or injuries that have been successfully treated.

Further, the base layer of the assembly may be attached by integral straps that tie, snap and so forth or by other known fastening mechanisms such as by sewing and gluing the base layer on, for example, clothing and the like. The base layer may be constructed using a stretchable (i.e., elastic) or non-stretchable material. The cover layer may be soft, as discussed above, or may include an outer surface made of hardened material, such as kevlar to provide bullet-proof protection. The kevlar material may instead be incorporated into a protective layer that includes integral hook or loop fasteners on the outer surfaces thereof.

Additionally, the protective pad assembly may be used to customize the grips on various objects such as steering wheels, tool handles, luggage handles, winch handles and handling ropes used in boating, and so forth. The cover layer may thus include a raw foam or similar outer surface that enhances a user's grip. Further the protective pad assembly may be used with various types of seats, such as desk chairs, rowing machine or other exercise machine seats, kayak or canoe seats, and so forth to provide customized protection. The protective pad assembly may, for example, be used in a gym setting with the exerciser carrying a portable protective pad assembly for use on an exercise bike during, for example, spinning classes. The base layer may be a slip-on cover, e.g., designed to fit over the exercise bike seat. As appropriate, the cover layer, or at least the outer surface thereof may be made of absorbent, washable material or the cover layer and/or the protective layers may be waterproof. The assembly may also be used to customize medical devices such as wheel chairs, walkers and so forth, to prevent and/or treat specific injuries.

What is claimed is:

1. A glove with a protective pad assembly, comprising:

a base layer, integrally formed of loop fasteners, that extends over a user's palm and encircles a user's thumb to protect a user's hand to which protective layers are to be applied, the base layer comprising the loop fasteners on an outwardly facing surface to provide a soft surface and to allow placement of a plurality of protective layers corresponding to an injury to a median nerve, the user's thumb, or bones or joints covered by the base layer; and the plurality of protective layers comprising protective material with hook fasteners on a first side and loop fasteners on a second surface, wherein respective layers of the plurality of protective layers are smaller than the base layer and sized to cover regions of the base layer that correspond to the injury to the median nerve, the user's thumb, or bones or joints covered by the glove, wherein the plurality of protective layers are configured to be readily repositioned by the user relative to the base layer to provide a selected number of protective layers to selected locations that correspond to the injury to the median nerve, the user's thumb, or bones or joints covered by the glove, wherein the protective layers are further configured to fasten to the base layer by a first side of a protective layer fastened to the loop fasteners on the base layer and a second side of the first protective layer attached to a first side of a second protective layer to provide at a given selected location protection of at least two protective layers attached to the base layer and to provide at any other selected locations as needed protection of a same or a different number of protective layers readily repositioned by the user.

2. The assembly of claim 1, further comprising:

a cover layer comprising a smooth outer surface and an inner surface with fasteners that secure the cover layer in place relative to an outermost protective layer.

3. The assembly of claim 2 wherein at least one of the protective layers or the cover layer is waterproof.

4. The assembly of claim 1 wherein the protective material is padding.

5. The assembly of claim 4 wherein the padding is closed cell foam.

6. The assembly of claim 1 wherein the protective material is a gel pad.

7. The assembly of claim 1 wherein the protective material is a hot or cold pack.

8. The assembly of claim 1 wherein the protective material is a thermal resistant material.

9. The assembly of claim 1 wherein the protective material for one or more of the protective layers comprises a rigid material.

10. The assembly of claim 9 wherein the rigid material is a splint.

11. The assembly of claim 1 wherein at least one of the plurality of protective layers extends past an area covered by the base layer.

12. The assembly of claim 1 wherein the loop fasteners on the surfaces of the base layer and protective layers are used in a hook and loop fastening system.

13. A glove with a protective pad assembly, comprising:

a removable base layer, integrally formed of loop fasteners, that covers a user's palm and portions of a user's thumb, the base layer comprising the loop fasteners on an internal facing surface to provide a soft surface against the user's palm and to allow placement of a plurality of removably located protective layers corresponding to particular nerves, bones, joints or tendons covered by the base layer; and wherein the plurality of removably located protective layers comprise protective material with hook fasteners on a first surface and loop fasteners on a second surface, wherein respective layers of the plurality of removably located protective layers are smaller than the base layer and sized to cover regions of the base layer that correspond to locations of injuries to the particular nerves, bones, joints or tendons covered by the base layer, wherein the plurality of removably located protective layers are configured to be readily repositioned by the user relative to the base layer to provide a selected number of removably located protective layers to customizably selected locations that correspond to the locations of the injuries to the nerves, bones, joints or tendons covered by the base layer, wherein the removably located protective layers are further configured to fasten to the base layer by the first side of a first removably located protective layer fastened to the loop fasteners on the internal surface of the base layer and the second side of the first removably located protective layer attached to a first side of a second removably located protective layer to provide at a given selected location of at least two removably located protective layers attached to the internal surface of the base layer and to provide at any other selected locations as needed protection of a same or a different number of removably located protective layers readily repositioned by the user at any given time.

14. A glove, comprising:

a base layer, integrally formed of loop fasteners, that covers a user's hand and portions of a user's thumb, wherein the base layer comprises the loop fasteners on an internal and outwardly facing surface of the base layer; and a plurality of removably located protective layers comprising protective material with hook fasteners on a first side and loop fasteners on a second surface, wherein respective removably located protective layers are smaller than the base layer and sized to cover an injured nerve within a hand of the user, an inflamed area on the hand of the user or an injury to a thumb of the user, wherein the plurality of removably located protective layers are configured to be readily repositioned by the user relative to the base layer to provide a selected number of removably located protective layers to customizably selected locations on the base layer that correspond to the injured nerve within the hand of the user, the inflamed area on the hand of the user or the injury to the thumb of the user thumb, the removably located protective layers further configured to fasten to the base layer by a first side of a first removably located protective layer fastened to the loop fasteners on the internal or outwardly facing surface of the base layer and a second side of the first removably located protective layer attached to a first side of a second removably located protective layer to one another to provide at a given selected location protection of at least two removably located protective layers attached to the surface of the base layer and to provide at any other selected locations as needed protection of a same or a different number of removably located protective layers at any given time.

15. The glove of claim 14, wherein the protective material is padding placed on the internal facing surface.

16. The glove of claim 15, wherein the padding is closed cell foam.

17. The glove of claim 14, wherein the protective material is a gel pad placed on the internal facing surface.

18. The glove of claim 14, wherein the protective material is a hot or cold pack placed on the internal facing surface.

19. The glove of claim 14, wherein the protective material is a thermal resistant material placed on the internal facing surface.

20. The glove of claim 14, wherein the protective material for one or more of the removably located protective layers comprises a rigid material.

21. The glove of claim 20, wherein the rigid material is a splint.

* * * * *

UNITED STATES PATENT AND TRADEMARK OFFICE

CERTIFICATE OF CORRECTION

PATENT NO. : 7,761,929 B1
APPLICATION NO. : 10/776412
DATED : July 27, 2010
INVENTOR(S) : Michael Mascia It is certified that error appears in the above-identified patent and that said Letters Patent is hereby corrected as shown below:

The Title Page, showing an illustrative Figure, should be deleted and substitute therefor the attached title page.

Please replace Figures 1-20 with the following figures attached hereto.

Signed and Sealed this
Twenty-fourth Day of July, 2012

David J. Kappos

David J. Kappos
*Director of the United States Patent and Trademark Office*

(12) United States Patent
Mascia

(10) Patent No.: US 7,761,929 B1
(45) Date of Patent: Jul. 27, 2010

(54) PROTECTIVE PAD ASSEMBLY

(76) Inventor: Michael Mascia, 1417 Moss St., New Orleans, LA (US) 70119

( * ) Notice: Subject to any disclaimer, the term of this patent is extended or adjusted under 35 U.S.C. 154(b) by 961 days.

(21) Appl. No.: 10/776,412

(22) Filed: Feb. 11, 2004

Related U.S. Application Data

(60) Provisional application No. 60/446,445, filed on Feb. 11, 2003.

(51) Int. Cl.
*A41D 13/00* (2006.01)

(52) U.S. Cl. ..... 2/16

(58) Field of Classification Search ..... 2/16, 2/19, 20, 159, 160, 161.1, 170
See application file for complete search history.

(56) References Cited

U.S. PATENT DOCUMENTS

| | | | | |
|---|---|---|---|---|
| 1,797,116 | A | | 3/1931 | Barden |
| 3,583,704 | A | | 6/1971 | Callanan |
| 3,598,408 | A | | 8/1971 | Klose |
| 3,885,249 | A | | 5/1975 | De Brabander |
| 3,994,025 | A | | 11/1976 | Petroski |
| 4,042,975 | A | | 8/1977 | Elliott, Jr. et al. |
| 4,183,100 | A | | 1/1980 | De Marco |
| 4,190,906 | A | | 3/1980 | Patton, Jr. |
| 4,270,228 | A | | 6/1981 | Gaiser |
| 4,556,215 | A | | 12/1985 | Tarbox et al. |
| 4,590,625 | A | | 5/1986 | Keun |
| 4,617,684 | A | | 10/1986 | Green et al. |
| 4,691,387 | A | | 9/1987 | Lopez |
| 4,754,499 | A | | 7/1988 | Pirie |
| 4,774,724 | A | * | 10/1988 | Sacks ..... 2/2.5 |
| 5,081,715 | A | * | 1/1992 | Mascia ..... 2/20 |
| 5,257,418 | A | * | 11/1993 | Jaskiewicz ..... 2/20 |
| 5,465,425 | A | * | 11/1995 | Crispin ..... 2/102 |
| 6,493,879 | B1 | * | 12/2002 | Hibler ..... 2/49.1 |
| 6,817,032 | B2 | * | 11/2004 | Hollander ..... 2/69 |
| 6,868,553 | B2 | * | 3/2005 | Kleinert ..... 2/19 |

FOREIGN PATENT DOCUMENTS

| | | |
|---|---|---|
| DE | 0148604 | 6/1981 |

OTHER PUBLICATIONS

Velcro Product News, PN. No. 46, Jun. 1978.

* cited by examiner

*Primary Examiner*—Tejash Patel
(74) *Attorney, Agent, or Firm*—Cesari and McKenna, LLP; Patricia A. Sheehan

(57) ABSTRACT

A configurable protective pad assembly includes a first, or base, layer that provides as an inner and/or outer surface one part of a two-part fastener system, such as, for example, the hooks or loops of a hook and loop fastener system. A protective layer, which consists of padding that incorporates fasteners on its surfaces, is sized and arranged relative to the base layer to provide customized protection to one or more desired locations. The protective layer attaches to the base layer as one or more sections that are sized and arranged in positions that correspond to the respective locations in which protection is desired. As desired, additional protective layers may be applied in the same manner, to provide more padding to all or various of the locations. A cover layer having a smooth outer surface may be applied over the protective layers to complete the assembly.

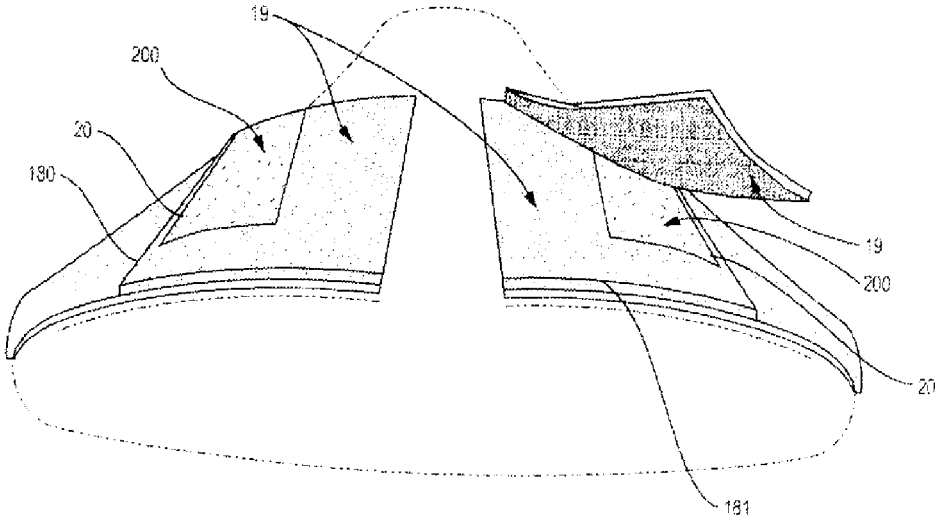

21 Claims, 20 Drawing Sheets